US009500334B2

(12) United States Patent
Iwasaki

(10) Patent No.: US 9,500,334 B2
(45) Date of Patent: Nov. 22, 2016

(54) VEHICLE LAMP HAVING AUXILIARY LENS WITH MAIN LENS

(71) Applicant: ICHIKOH INDUSTRIES, LTD., Isehara-shi, Kanagawa-ken (JP)

(72) Inventor: Kazunori Iwasaki, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 0 days.

(21) Appl. No.: 14/781,812

(22) PCT Filed: Apr. 1, 2014

(86) PCT No.: PCT/JP2014/059662
§ 371 (c)(1),
(2) Date: Oct. 1, 2015

(87) PCT Pub. No.: WO2014/163088
PCT Pub. Date: Oct. 9, 2014

(65) Prior Publication Data

US 2016/0025291 A1 Jan. 28, 2016

(30) Foreign Application Priority Data

Apr. 2, 2013 (JP) ..... 2013-077086
Apr. 2, 2013 (JP) ..... 2013-077087
Apr. 2, 2013 (JP) ..... 2013-077151
Apr. 2, 2013 (JP) ..... 2013-077152

(51) Int. Cl.
*F21S 8/10* (2006.01)
*F21V 13/04* (2006.01)
*F21Y 101/02* (2006.01)

(52) U.S. Cl.
CPC ..... *F21S 48/1283* (2013.01); *F21S 48/1154* (2013.01); *F21S 48/1216* (2013.01); *F21S 48/1275* (2013.01); *F21S 48/1291* (2013.01); *F21S 48/13* (2013.01); *F21S 48/14* (2013.01); *F21S 48/145* (2013.01); *F21V 13/04* (2013.01); *F21Y 2101/02* (2013.01)

(58) Field of Classification Search
CPC ..... F21S 48/1283; F21S 48/1154; F21S 48/1291; F21S 48/17; F21S 48/13; F21S 48/1311; F21S 48/1275; F21S 48/125; F21S 48/1216; F21V 13/04
USPC ..... 362/520
See application file for complete search history.

(56) References Cited

U.S. PATENT DOCUMENTS 8,646,955 B2 * 2/2014 Okubo ..... B60Q 1/04 362/464
9,150,144 B2 * 10/2015 Abe ..... B60Q 1/04
2009/0154185 A1 * 6/2009 Yagi ..... F21S 48/1154 362/516
2015/0300589 A1 * 10/2015 Iwasaki ..... F21S 48/1154 362/520

FOREIGN PATENT DOCUMENTS

JP 2009-283299 A 12/2009

* cited by examiner

*Primary Examiner* — Karabi Guharay
(74) *Attorney, Agent, or Firm* — Foley & Lardner LLP

(57) ABSTRACT

The invention is provided with a lens and a semiconductor-type light source. The lens comprises a main lens part and an auxiliary lens par. The auxiliary lens part comprises a light entry surface, a reflection surface, a light exit surface, and a first connection surface. A light processing part for dispersing light from the semiconductor-type light source is provided to the first connection surface. As a result, this invention is able to process upwardly emitted light.

15 Claims, 15 Drawing Sheets

VEHICLE LAMP HAVING AUXILIARY LENS WITH MAIN LENS

TECHNICAL FIELD

An embodiment of the present invention relates to a vehicle lamp provided with a lens and a semiconductor-type light source. In particular, an embodiment of the present invention relates to a lens direct type vehicle lamp.

BACKGROUND ART

A vehicle lamp of this type is conventional (for example, Patent Literature 1). Hereinafter, a conventional vehicle lamp will be described. A conventional vehicle lamp comprises a convex lens, an additional lens, and a light-emitting element. A conventional vehicle lamp irradiates light emitted from a light-emitting element as a basic light distribution pattern from a convex lens, and irradiates light emitted from a light-emitting element as an additional light distribution pattern from an additional lens.

CITATION LIST

Patent Literature

Patent Literature 1: JP-A-2009-283299

SUMMARY OF THE INVENTION

Problems to be Solved by the Invention

In such a vehicle lamp, light from a light-emitting element may exit to the outside from an additional lens without being subjected to light distribution control by an additional lens. For example, light not being subjected to light distribution control may exit upward or downward to the outside from an additional lens. Thus, in such a vehicle lamp, an upward or downward exit light not being subjected to light distribution control may become stray light.

A problem to be solved by an embodiment of the present invention is that upward or downward exit light not being subjected to light distribution control may become stray light.

Means for Solving the Problem

A vehicle lamp comprising a lens and a semiconductor-type light source according to an aspect of the present invention, wherein: the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part; a reflection surface that reflects light entering from the light entry surface to the auxiliary lens part; a light exit surface that emits a reflection light reflected by the reflection surface to the outside from the auxiliary lens part; and a connection surface that connects the main lens part and the light entry surface; and the connection surface is provided with a light processing part that diffuses or shields light from the semiconductor-type light source.

The vehicle lamp according to other aspect, wherein the light processing part comprises a diffusion prism that diffuses light from the semiconductor-type light source.

The vehicle lamp according to other aspect, wherein: the main lens part comprises a light entry surface that is connected to the light entry surface of the auxiliary lens part via the connection surface; and a light exit surface that forms an aspheric convex surface, the light exit surface of the auxiliary lens part forms an aspheric convex surface, and a bending direction of the light exit surface of the auxiliary lens part forming an aspheric convex surface is in the same direction of a bending direction of the light exit surface of the main lens part forming an aspheric surface.

A vehicle lamp comprising a lens and a semiconductor-type light source according to other aspect, wherein: the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part; a reflection surface that reflects light entering from the light entry surface to the auxiliary lens part; a light exit surface that emits a reflection light reflected by the reflection surface to the outside from the auxiliary lens part; and a connection surface that connects the main lens part and the light entry surface; and the connection surface is formed by a surface inclined at an angle for emitting light from the semiconductor-type light source, that is, light entering from the connection surface to the auxiliary lens part, downwardly to the outside from the light exit surface of the auxiliary lens part.

The vehicle lamp according to other aspect, wherein: a flange part is provided on a periphery of the main lens part and the auxiliary lens part, the flange part is attached to a lens holder, and the lens holder is provided with a light shielding part that shields light emitted downwardly to the outside from a light exit surface of the auxiliary lens part.

The vehicle lamp according to other aspect, wherein the lens holder comprises a light opaque member, and comprises a low light reflective member, or a surface thereof is treated to be low light reflective.

The vehicle lamp according to other aspect, wherein: the main lens part comprises a light entry surface that is connected to the light entry surface of the auxiliary lens part via the connection surface, and a light exit surface that forms an aspheric convex surface, the light exit surface of the auxiliary lens part forms an aspheric convex surface, and a bending direction of the light exit surface of the auxiliary lens part forming an aspheric convex surface is in the same direction as a bending direction of the light exit surface of the main lens part forming an aspheric convex surface.

A vehicle lamp comprising a lens and a semiconductor-type light source according to other aspect of the present invention, wherein: the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part; a reflection surface that reflects light entering from the light entry surface to the auxiliary lens part; a light exit surface that emits a reflection light reflected by the reflection surface to the outside from the auxiliary lens part; and a connection surface that connects the main lens part and the light entry surface; and a light shielding part is provided in the vicinity of a light exit surface of the auxiliary lens part, the light shielding part shielding light from the semiconductor-type light source, that is, light entering from the connection surface to the auxiliary lens part, and exiting to the outside from the light exit surface of the auxiliary lens part.

The vehicle lamp according to other aspect, wherein: a flange part is provided on a periphery of the main lens part and the auxiliary lens part, the flange part is attached to a lens holder, and the light shielding part is provided in the lens holder.

The vehicle lamp according to other aspect, wherein the lens holder comprises a light opaque member, and comprises a low light reflective member, or a surface thereof is treated to be low light reflective.

The vehicle lamp according to other aspect, wherein: the main lens part comprises a light entry surface that is connected to the light entry surface of the auxiliary lens part via the connection surface, and a light exit surface that forms an aspheric convex surface, the light exit surface of the auxiliary lens part forms an aspheric convex surface, and a bending direction of the light exit surface of the auxiliary lens part forming an aspheric convex surface is in the same direction as a bending direction of the light exit surface of the main lens part forming an aspheric convex surface.

A vehicle lamp comprising a lens and a semiconductor-type light source according to other aspect of the present invention, wherein: the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part; a reflection surface that reflects light entering from the light entry surface to the auxiliary lens part; and a light exit surface that emits a reflection light reflected by the reflection surface to the outside from the auxiliary lens part; and a light distribution control part, that controls a part of light distribution of the auxiliary light distribution pattern, is provided on a light exit surface side of the auxiliary lens part.

The vehicle lamp according to other aspect, wherein the light distribution control part is formed by changing an angle of a part of a light exit surface of the auxiliary lens part, and shifts a part of the auxiliary light distribution pattern.

The vehicle lamp according to other aspect, wherein the light distribution control part is a light shielding part provided in front of a light exit surface of the auxiliary lens part, and shields a part of the auxiliary light distribution pattern.

The vehicle lamp according to other aspect, wherein: the main light distribution pattern is a low beam light distribution pattern including an oblique cutoff line, the auxiliary light distribution pattern is an overhead sign light distribution pattern, a lower boundary line of the overhead sign light distribution pattern is located below the oblique cutoff line, and a part of the overhead sign light distribution pattern subjected to light distribution control by the light distribution control part is within the vicinity of the oblique cutoff line.

Effect of the Invention

In a vehicle lamp according to an embodiment of the present invention, when light emitted from a semiconductor-type light source enters an auxiliary lens part from a connection surface by a light processing part provided on the connection surface, the light emitted from the semiconductor-type light source is diffused or shielded by a light processing part provided on the connection surface. As a result, it is possible to suppress stray light caused by upward or downward exit light not being subjected to light distribution control.

Further, in a vehicle lamp according to an embodiment of the present invention, by adjusting an angle of punching a mold of a connection surface, it is possible to emit the light from the semiconductor-type light source, that is, the light entering from the connection surface to the auxiliary lens part, downward to the outside from a light exit surface of the auxiliary lens part. As a result, glare is not given to a driver of an oncoming vehicle or a preceding vehicle.

Further, in a vehicle lamp according to an embodiment of the present invention, a light shielding part is able to shield the light from the semiconductor-type light source, that is, the light entering from the connection surface of the auxiliary lens part to the auxiliary lens part and exiting to the outside from a light exit surface of the auxiliary lens part, namely the light that is not subjected to light distribution control by the auxiliary lens part as per a light distribution design. As a result, it is possible to prevent the light not subjected to light distribution control from exiting to the outside from the auxiliary lens part.

Further, in a vehicle lamp according to an embodiment of the present invention, by a light distribution control part, it is possible to control light distribution of a part of an auxiliary light distribution pattern. As a result, it is possible to control precisely the light distribution of the auxiliary light distribution pattern.

MODES FOR CARRYING OUT THE INVENTION

Figure 1:
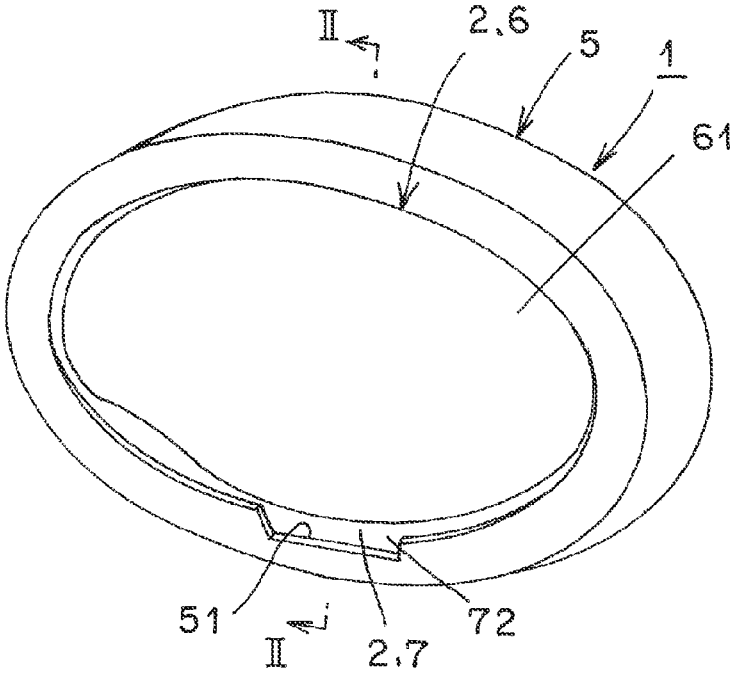
FIG. 1 is a perspective view showing an embodiment 1 of a vehicle lamp according to an embodiment of the present invention.

Hereinafter, an embodiment (example) of a vehicle lamp according to an embodiment of the present invention will be described in detail with reference to the drawings. The invention is not to be limited by the embodiment. In this specification and attached claims, front, back, top, bottom, left, right are front, back, top, bottom, left, right when a vehicle lamp according to an embodiment of the invention is mounted on a vehicle. In the drawings, a symbol "VU-VD" represents a vertical line extending from the top to the bottom of a screen. A symbol "HL-HR" represents a horizontal line extending from the left to the right of a screen.

Description of Configuration of Embodiment 1

Figure 2:
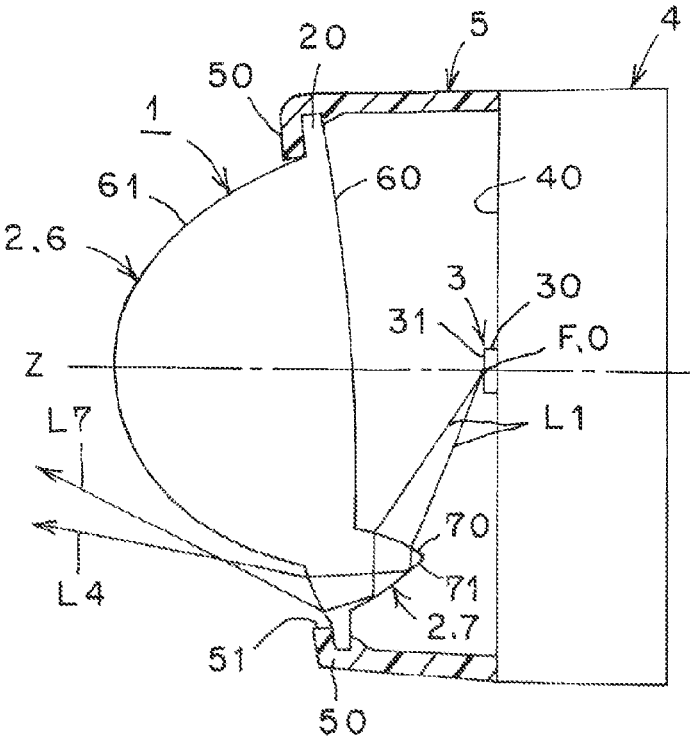
FIG. 2 is a sectional view taken along line II-II in FIG. 1 (embodiment 1).

FIGS. 1 to 7 show an embodiment 1 of a vehicle lamp according to the invention. Hereinafter, a configuration of the vehicle lamp according to the embodiment 1 will be described. In FIGS. 1 and 2, a reference numeral 1 denotes a vehicle lamp in this embodiment (e.g., a headlamp). The vehicle lamp 1 is mounted on the left and right ends of the front of a vehicle.

(Description of Vehicle Lamp 1)

The vehicle lamp 1 is, as shown in FIGS. 1 and 2, provided with a lamp housing (not shown), a lamp lens, for example, a plain outer lens (not shown), a lens 2, a semiconductor-type light source 3, a heat sink member 4, and a lens holder 5.

The lens 2, the semiconductor-type light source 3, the heat sink member 4, and the lens holder 5 configure a lamp unit. The lamp housing and the lamp lens define a lamp chamber (not shown). The lamp unit 2, 3, 4, 5 is disposed in the lamp chamber. The lamp unit 2, 3, 4, 5 is being attached to the lamp housing via a vertical direction optical axis adjustment mechanism (not shown) and a horizontal direction optical axis adjustment mechanism (not shown).

(Description of Lens 2)

Figure 3:
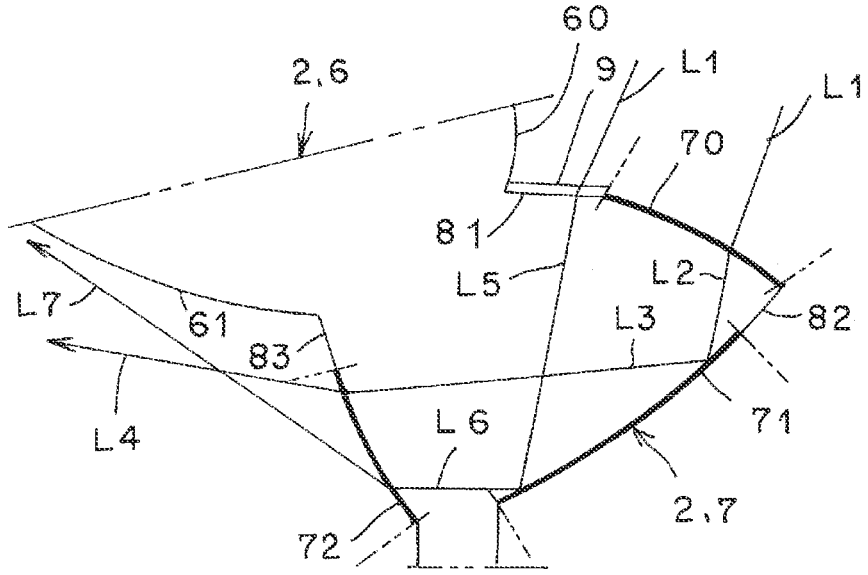
FIG. 3 is an explanatory drawing showing an optical path in an auxiliary lens part (embodiment 1).

The lens 2 comprises, as shown in FIGS. 1 to 3, a main lens part 6, an auxiliary lens part (additional lens part) 7, and a flange part 20. The flange part 20 is provided integrally on a periphery of the main lens part and the auxiliary lens part 7. The lens 2 comprises a lens made of resin, such as PC material, PMMA material, and PCO material. In other words, light emitted from the semiconductor-type light source 3 does not have high heat, and a resin lens can be used for the lens 2.

(Description of Main Lens Part 6)

The main lens part 6 is, as shown in FIG. 2, an aspheric projection lens (a convex lens) having a reference optical axis Z and a reference focus F. The main lens part 6 uses light in the center of the semiconductor-type light source 3 (not shown). The light in the center of the semiconductor-type light source 3 is light within latitude of about 50° of a spherical radiation range of the semiconductor-type light source 3, out of light emitted from the semiconductor-type light source 3.

The main lens part 6 comprises a light entry surface 60 and a light exit surface 61. The light entry surface 60 enters light emitted from the semiconductor-type light source 3 (not shown) into the main lens part 6. The light exit surface 61 emits the light entered into the main lens part 6. The light entry surface 60 is configured of a free-form surface or a composite quadratic surface. The light entry surface 60 forms a substantially planar aspheric surface (convex or concave with respect to the semiconductor-type light source 3). The light exit surface 61 is formed in a convex shape projecting to the opposite side of the semiconductor-type light source 3, and is configured of a free-form surface or a composite quadratic surface. The light exit surface 61 forms an aspheric convex surface.

The light entry surface 60 and the light exit surface 61 of the main lens part 6 control the light distribution of light from the semiconductor-type light source 3, and irradiate the light to the forward of a vehicle as a main light distribution pattern. The main light distribution pattern is a low beam light distribution pattern (a passing light distribution pattern) shown in FIG. 5 in this embodiment 1.

(Description of Low Beam Light Distribution Pattern LP)

Figure 5:
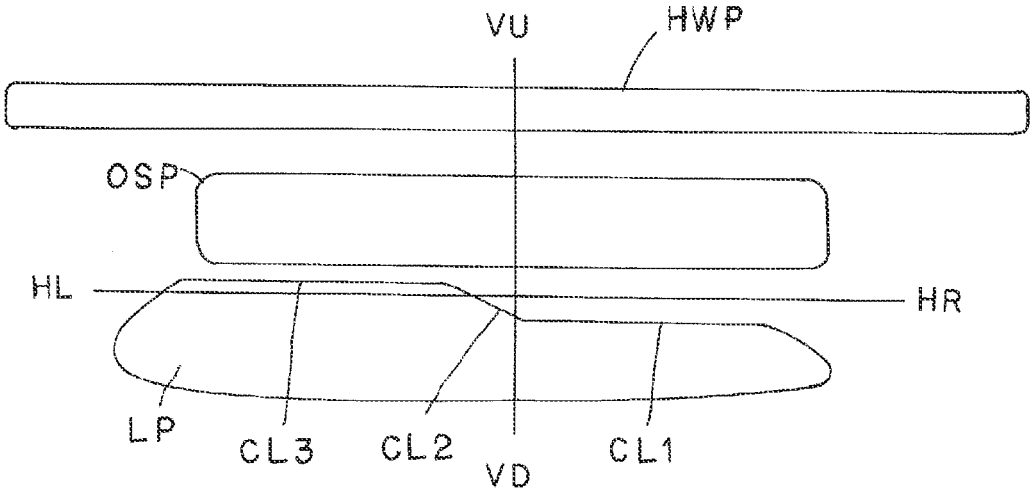
FIG. 5 is an explanatory drawing showing an overhead sign light distribution pattern and a low beam light distribution pattern in a case where upward exit light has been processed (embodiment 1).

The low beam light distribution pattern LP includes, as shown in FIG. 5, a lower horizontal cutoff line CL1, an oblique cutoff line CL2, and an upper horizontal cutoff line CL3.

(Description of Auxiliary Lens Part 7)

The auxiliary lens part 7 is, as shown in FIGS. 1 to 3, provided on the periphery of the main lens part 6, on the lower side in this embodiment 1. The auxiliary lens part 7 effectively uses light L1 around the semiconductor-type light source 3. The light L1 around the semiconductor-type light source 3 is light within latitude of about 50° of a spherical radiation range of the semiconductor-type light source 3, out of the light emitted from the semiconductor-type light source 3. The auxiliary lens part 7 is integral with the main lens part 6.

The auxiliary lens part 7 comprises a light entry surface 70, a reflection surface 71, and a light exit surface 72. The light entry surface 70 enters the light L1 emitted from the semiconductor-type light source 3 into the auxiliary lens part 7. The reflection surface 71 reflects incident light L2 entered into the auxiliary lens part 7. The light exit surface 72 emits reflection light L3 reflected by the reflection surface 71 as exit light L4. The light entry surface 70, the reflection surface 71, and the light exit surface 72 are each configured of a free-form surface. The light exit surface 72 forms an aspheric convex surface.

A bending direction (arc direction) of the light exit surface 72 forming an aspheric convex surface is in the same direction as a bending direction (arc direction) of the light exit surface 61 of the main lens part 6 forming an aspheric convex surface. As a result, the auxiliary lens part 7 is inconspicuous to the main lens part 6, and the appearance is improved. On the other hand, in the vehicle lamp of Patent Document 1, a bending direction (arc direction) of a convex light exit surface of a convex lens is in the reverse direction to a bending direction (arc direction) of an uneven light exit surface of an additional lens.

The light entry surface 70, the reflection surface 71, and the light exit surface 72 of the auxiliary lens part 7 control the light distribution of the light L1 from the semiconductor-type light source 3, and irradiate the light to the forward and upward of a vehicle as an auxiliary light distribution pattern (an additional light distribution pattern). The auxiliary light distribution pattern is an overhead sign light distribution pattern OSP shown in FIG. 5 in this embodiment 1.

(Description of Overhead Sign Light Distribution Pattern OSP)

As shown in FIG. 5, the overhead sign light distribution pattern OSP is located above the cutoff line CL1, CL2, CL3 of the low beam light distribution pattern LP.

(Description of Modeling of Auxiliary Lens Part 7)

Hereinafter, modeling of the auxiliary lens part 7 will be described. First, the reflection surface 71, the light entry surface 70, and the light exit surface 72 are each designed for light distribution to form the overhead sign light distribution pattern OSP. In the step of light distribution design, as shown by a thick solid line in FIG. 3, the light entry surface 70, the reflection surface 71, and the light exit surface 72 are not connected to each other, and not connected to the light entry surface 60 and the light exit surface 61 of the main lens part 6. Thus, in the step of light distribution design, modeling of the auxiliary lens part 7 is impossible.

Next, the light entry surface 60 of the main lens part 6 is connected to the light entry surface 70 of the auxiliary lens part 7 by a first connection surface 81. The light entry surface 70 of the auxiliary lens part 7 is connected to the reflection surface 71 of the auxiliary lens part 7 by a second connection surface 82. The reflection surface 71 of the auxiliary lens part 7 is connected to the light exit surface 72 of the auxiliary lens part 7 by the flange part 20 or a connection surface (not shown). The light exit surface 72 of the auxiliary lens part 7 is connected to the light exit surface 61 of the main lens part 6 by a third connection surface 83. As a result, the auxiliary lens part 7 can be modeled.

(Description of Semiconductor-type Light Source 3)

Figure 4:
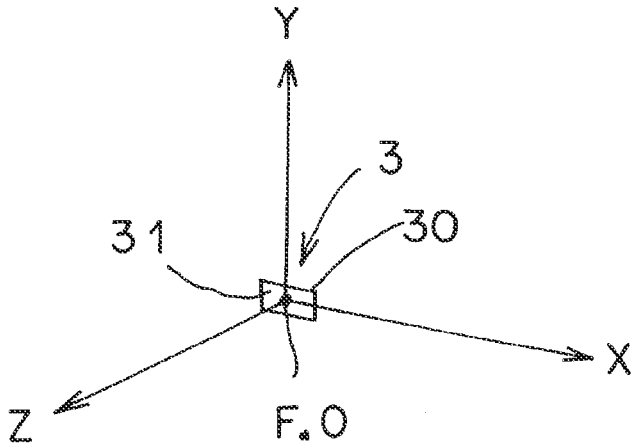
FIG. 4 is an explanatory drawing showing a light emission surface of a light-emitting chip of a semiconductor-type light source (embodiment 1).

The semiconductor-type light source 3 is, as shown in FIGS. 2 and 4, a self-emitting semiconductor-type light source such as an LED, OEL, or OLED (organic EL). The semiconductor-type light source 3 comprises a package (LED package) that is formed by sealing a light-emitting chip (LED chip) 30 with a sealing resin member. The package is mounted on a substrate (not shown). A current is supplied from a power supply (battery) to the light-emitting chip 30 via a connector (not shown) attached to the substrate. The semiconductor-type light source 3 is attached to the heat sink member 4.

The light-emitting chip 30 is, as shown in FIG. 4, forms a planar rectangular shape (a flat rectangle). In other words, four square chips are arranged in the X-axis direction (a horizontal direction). Two, three, five or more square chips may be used. Alternatively, one rectangular chip or one square chip may be used. The front of the light-emitting chip 30, a rectangular front in this example, forms a light emission surface 31. The light emission surface 31 faces the forward of the reference optical axis Z (a reference axis) of the main lens part 6 of the lens 2. The center O of the light emission surface 31 of the light-emitting chip 30 is located at the or near the reference focus F of main lens part 6 of the lens 2, and is located on the or near the reference optical axis Z of the main lens part 6 of the lens 2.

In FIG. 4, X, Y, and Z constitute an orthogonal coordinate (an X-Y-Z orthogonal coordinate system). The X-axis is a horizontal axis in a lateral direction passing through the center O of the light emission surface 31 of the light-emitting chip 30. In this embodiment, the left side of the X-axis is a + direction, and the right side is a – direction. The Y-axis is a vertical axis in a perpendicular direction passing through the center O of the light emission surface 31 of the light-emitting chip 30. In this embodiment, the upper side of the Y-axis is a + direction, and the lower side is a – direction. Further, the Z-axis is a normal (perpendicular) line passing through the center O of the light emission surface 31 of the light-emitting chip 30, that is, an axis in the longitudinal direction (the reference optical axis Z of the lens 2) orthogonal to the X-axis and Y-axis. In this embodiment, the front side of the Z-axis is a + direction, and the rear side is a – direction.

(Description of Heat Sink Member 4)

The heat sink member 4 includes, as shown in FIG. 2, a mounting surface 40 that is vertical or substantially vertical, and a fin-shaped part (not shown). In the center of the mounting surface 40, the semiconductor-type light source 3 is attached. In the peripheral edge of the mounting surface 40, the lens holder 5 is attached. The heat sink member 4 and the lens holder 5 are separated in this embodiment 1, but they may be integrated.

(Description of Lens Holder 5)

The lens holder 5 forms a cylindrical shape covering the lens 2 as shown in FIGS. 1 and 2. On the front (front surface) of the lens holder 5, an opening is provided to expose the main lens part 6 and the auxiliary lens part 7 of the lens 2. The lens holder 5 includes a fitting part 50 and a concave part 51. The fitting part 50 is provided on the inner surface of the peripheral edge of the opening. The flange part 20 of the lens 2 is fit to the fitting part 50. As a result, the lens 2 is attached to the heat sink member 4 via the lens holder 5. The concave part 51 is provided in the lower central part of the peripheral edge of the opening. In the concave part 51, the auxiliary lens part 7 is disposed. The lens holder 5 comprises a light opaque member. The lens holder 5 comprises a low light reflective member, or the surface thereof is treated to be low light reflective. The lens holder 5 comprises a black member.

(Description of Light Processing Part 9)

Figure 7:
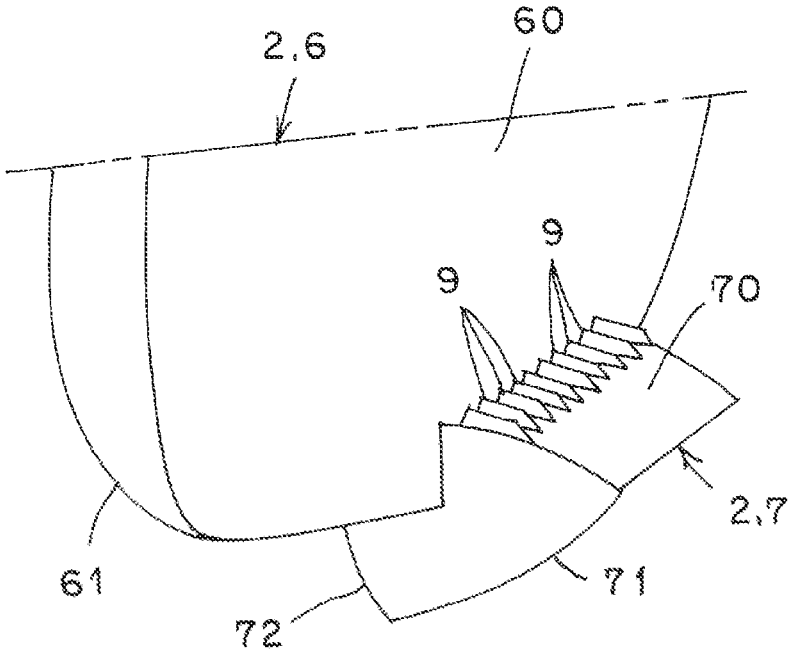
FIG. 7 is a perspective view showing a portion of a main lens part and an auxiliary lens part of a lens (embodiment 1).

As shown in FIGS. 3 and 7, a light processing part 9 is provided on the first connection surface 81. The light processing part 9 comprises, in this example, a diffusion prism that diffuses the light L1 from the semiconductor-type light source 3 in the lateral direction. The diffusion prism (light processing part 9) is a prism provided in the Z-axis direction, and is arranged in a large number in the X-axis direction.

Description of Functions of Embodiment 1

The vehicle lamp 1 in this embodiment 1 is configured as described above. Hereinafter, functions of the embodiment will be described.

When the light-emitting chip 30 of the semiconductor-type light source 3 is turned on, of the light emitted from the light-emitting chip 30, the light in the center of the semiconductor-type light source 3 refracts and enters the main lens part 6 from the light entry surface 60 of the main lens part 6. At this time, the incident light is subjected to light distribution control by the light entry surface 60. The incident light entered into the main lens part 6 refracts and exits from the light exit surface 61 of the main lens part 6. At this time, the exit light is subjected to light distribution control by the light exit surface 61. The exit light from the main lens part 6 is, as shown in FIG. 5, irradiated to the forward of a vehicle as a low beam light distribution pattern LP having cutoff lines CL1, CL2, CL3.

On the other hand, as shown in FIGS. 2 and 3, of the light emitted from the light-emitting chip 30, the light L1 around the semiconductor-type light source 3 refracts and enters the auxiliary lens part 7 from the light entry surface 70 of the auxiliary lens part 7. At this time, the light L1 from the semiconductor-type light source 3 is subjected to light distribution control by the light entry surface 70. The incident light L2 entered into the auxiliary lens part 7 is totally reflected by the reflection surface 71. At this time, the incident light L2 is subjected to light distribution control by the reflection surface 71. The reflection light L3 totally reflected by the reflection surface 71 refracts and exits from the light exit surface 72 of the auxiliary lens part 7. At this time, the reflection light L3 is subjected to light distribution control by the light exit surface 72. The exit light L4 from the light exit surface 72 of the auxiliary lens part 7 is, as shown in FIG. 5, irradiated to the forward and upward of a vehicle as an overhead sign light distribution pattern OSP.

Further, as shown in FIG. 3, of the light emitted from the light-emitting chip 30, the light L1 around the semiconductor-type light source 3 is diffused in a lateral direction and entered into the auxiliary lens part 7 from the light processing part 9 on the first connection surface 81. Incident light L5 diffused in a lateral direction and entered into the auxiliary lens part 7 is totally reflected by the reflection surface 71. Reflection light L6 totally reflected by the reflection surface 71 and diffused in a lateral direction refracts and exits upward from the light exit surface 72. Exit light L7 diffused in a lateral direction and emitted upward from the light exit surface 72 is, as shown in FIG. 5, irradiated above the overhead sign light distribution pattern OSP as a diffused light distribution pattern diffused in a lateral direction HWP.

Description of Effect of Embodiment 1

The vehicle lamp 1 in this embodiment 1 has the configuration and functions described above. Hereinafter, the effect of the embodiment will be described.

According to the vehicle lamp 1 in this embodiment 1, by the light processing part 9 provided on the first connection surface 81, the light L1 from the semiconductor-type light source 3 is diffused in the lateral direction when it enters the auxiliary lens part 7 from the first connection surface 81. As a result, as shown in FIG. 5, it is possible to process the upward exit light as a diffused light distribution pattern diffused in a lateral direction HWP. Therefore, glare is not given to a driver of an oncoming vehicle or a preceding vehicle.

Figure 6:
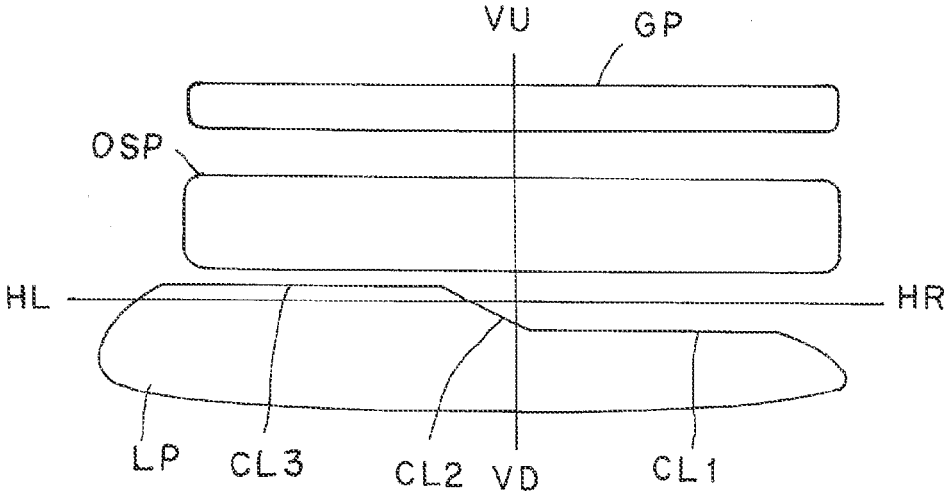
FIG. 6 is an explanatory drawing showing an overhead sign light distribution pattern and a low beam light distribution pattern in a case where upward exit light has not been processed (embodiment 1).

Now, a description will be given on an example that a light processing part (9) is not provided on a first connection surface (81). A sign put in ( ) corresponds to a sign in this embodiment 1. Light (L1) from a semiconductor-type light source (3) refracts and enters an auxiliary lens part (7) from a first connection surface (81). Incident light (L5) entered into the auxiliary lens part (7) is totally reflected by a reflection surface (71). Reflection light (L6) totally reflected by the reflection surface (71) refracts upward and exits from a light exit surface (72). Exit light (L7) emitted upward from the light exit surface (72) may, as shown in FIG. 6, give glare as a light distribution pattern GP to a driver of an oncoming vehicle or a preceding vehicle.

In contrast, in the vehicle lamp 1 of this embodiment 1, as described above, the light processing part 9 provided on the first connection surface 81 is able to diffuse the light L1 from the semiconductor-type light source 3 in the lateral direction, and process the upward exit light L7 as a diffused light distribution pattern diffused in a lateral direction HWP.

According to the vehicle lamp 1 in this embodiment 1, a bending direction of the light exit surface 72 of the auxiliary lens part 7 forming an aspheric convex surface is in the same direction as a bending direction of the light exit surface 61 of the main lens part 6 forming an aspheric convex surface. Therefore, the auxiliary lens part 7 is inconspicuous to the main lens part 6, and the appearance is improved.

Description of Embodiment 2

Figure 8:
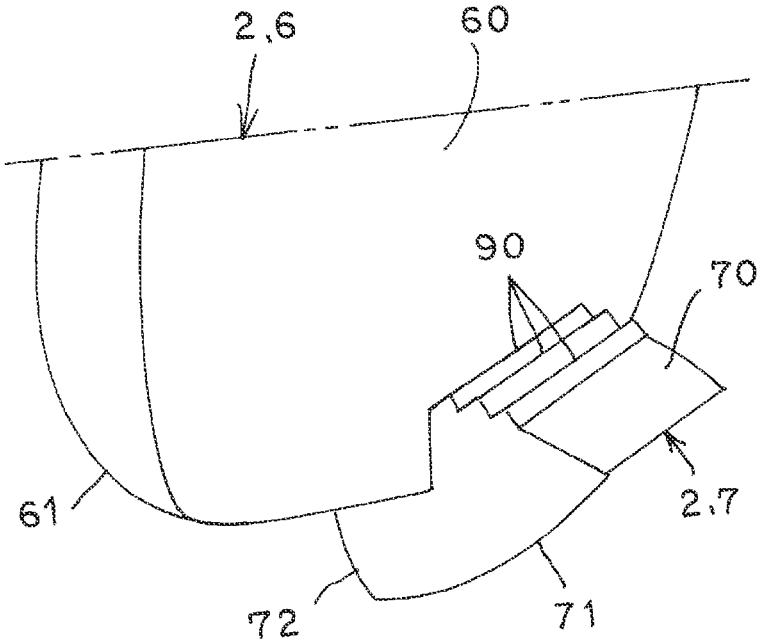
FIG. 8 is a perspective view of a portion of a main lens part and an auxiliary lens part of a lens showing an embodiment 2 of a vehicle lamp according to an embodiment of the invention (embodiment 2).
Figure 9:
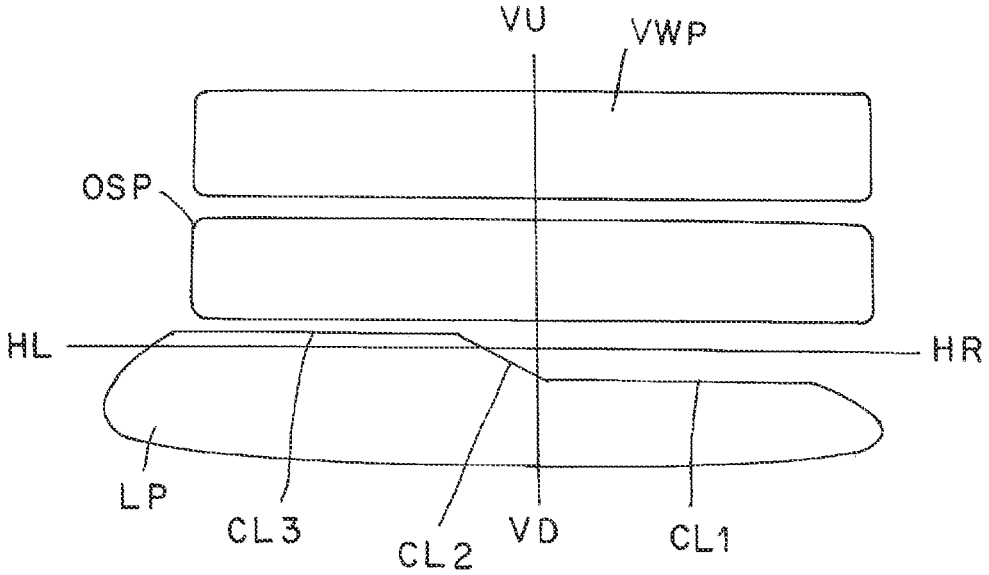
FIG. 9 is an explanatory drawing showing an overhead sign light distribution pattern and a low beam light distribution pattern in a case where upward exit light has been processed (embodiment 2).
Figure 10:
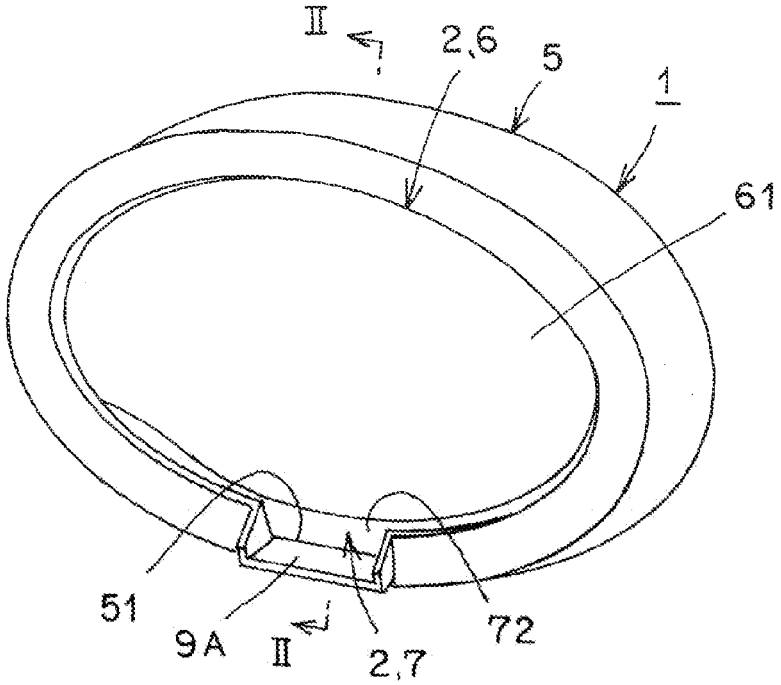
FIG. 10 is a perspective view showing an embodiment 3 of a vehicle lamp according to an embodiment of the invention.

FIG. 8 and FIG. 9 show an embodiment 2 of a vehicle lamp according to the invention. Hereinafter, a vehicle lamp in this embodiment 2 will be described. In the drawings, the same reference numerals as those in FIGS. 1 to 7 denote the same parts.

Description of Configuration of Embodiment 2

The light processing part 9 of the vehicle lamp 1 in the embodiment 1 comprises a diffusion prism that diffuses the light L1 from the semiconductor-type light source 3 in a lateral direction. On the contrary, a light processing part 90 of a vehicle lamp in the embodiment 2 comprises a diffusion prism that diffuses light from a semiconductor-type light source in a vertical direction. The diffusion prism (light processing part 90) is a prism provided in the X-axis direction, and is arranged in a plural in the Z-axis direction.

Description of Functions of Embodiment 2

The vehicle lamp in this embodiment 2 is configured as described above. Hereinafter, functions of the embodiment will be described. Light from the semiconductor-type light source is diffused vertically by the light processing part 90 on the first connection surface, and entered into the auxiliary lens part 7. The vertically diffused incident light entered into the auxiliary lens part 7 is totally reflected by the reflection surface 71. The vertically diffused reflection light totally reflected by the reflection surface 71 refracts upward and exits from the light exit surface 72. The vertically diffused exit light emitted upward from the light exit surface 72 is, as shown in FIG. 9, irradiated above the overhead sign light distribution pattern OSP as a diffused light distribution pattern diffused in a vertical direction VWP.

Description of Effect of Embodiment 2

The vehicle lamp in this embodiment 2 has the configuration and functions described above. Therefore, the embodiment can achieve substantially the same effect as that of the vehicle lamp 1 in the embodiment 1.

Description of Embodiment 3

FIGS. 10 to 15 show an embodiment of 3 of the vehicle lamp according to the present invention. Hereinafter, a vehicle lamp in this embodiment 3 will be described. In the drawings, the same reference numerals as those in FIGS. 1 to 9 denote the same parts, and a description thereof will be omitted.

Figure 12:
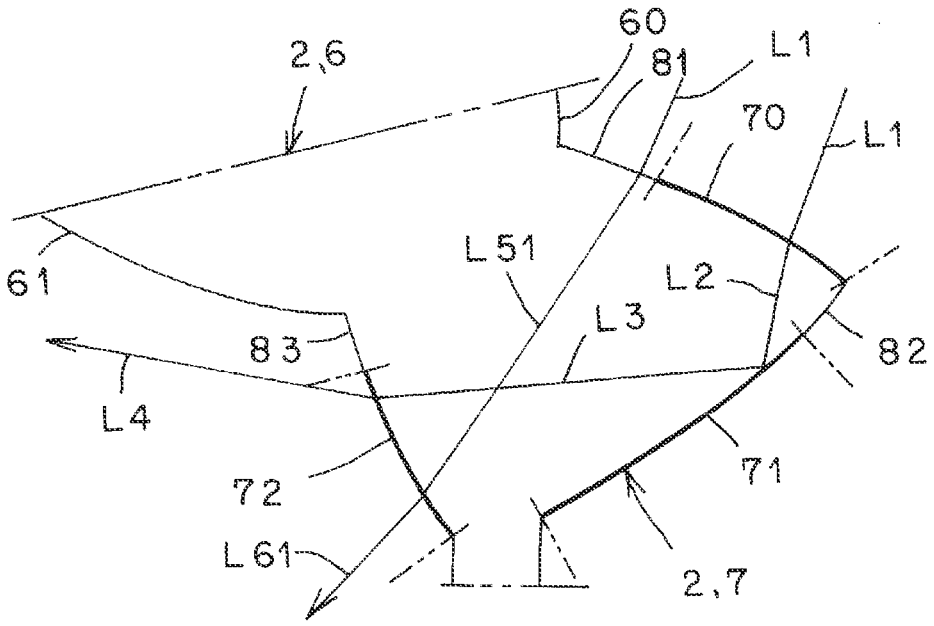
FIG. 12 is an explanatory drawing showing an optical path in an auxiliary lens part (embodiment 3).
Figure 13:
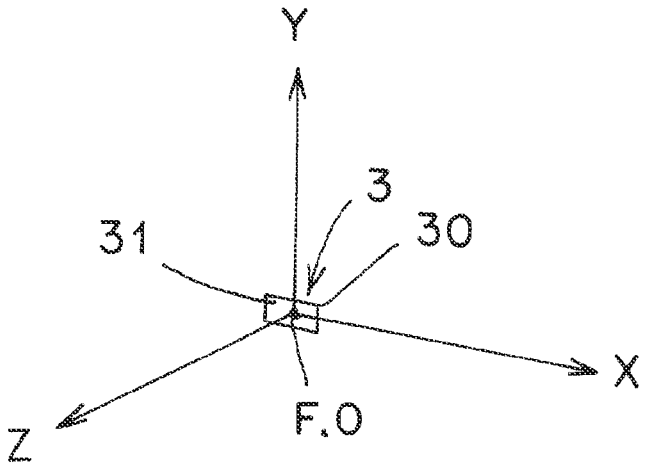
FIG. 13 is an explanatory drawing showing a light emission surface of a light-emitting chip of a semiconductor-type light source (embodiment 3).
Figure 14:
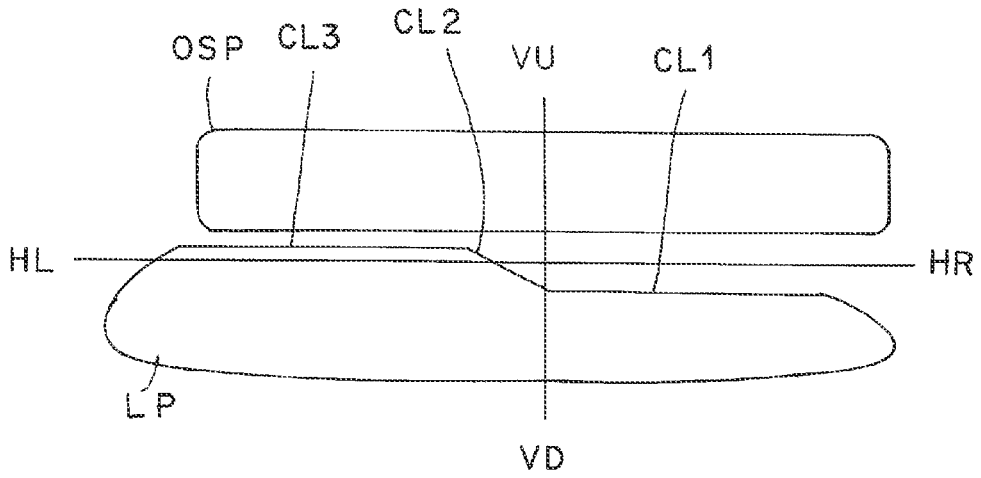
FIG. 14 is an explanatory drawing showing an overhead sign light distribution pattern and a low beam light distribution pattern (embodiment 3).

The vehicle lamp according to the embodiment 3 is, as shown in FIG. 12, provided with a lens 2 and a semiconductor-type light source 3. The lens 2 comprises a main lens part 6 and an auxiliary lens part 7. The auxiliary lens part 7 comprises a light entry surface 70, a reflection surface 71, a light exit surface 72, and a first connection surface 81. The first connection surface 81 is formed at an angle of punching a mold so that light L1 from the semiconductor-type light source 3, that is, incident light L51 entering from the first connection surface 81 to the auxiliary lens part 7 exits downward to the outside from the light exit surface 72 as a downward exit light L61. As a result, the embodiment of the invention is able to downwardly emit the exit light L6 not subjected to light distribution.

In a conventional vehicle lamp, light from a light-emitting element may exit to the outside from an additional lens without being subjected to light distribution control by an additional lens. For example, light being not subjected to light distribution control may exit upward to the outside from an additional lens.

A problem to be solved by the vehicle lamp according to the embodiment 3 is that light being not subjected to light distribution control may exit upwardly to the outside from an additional lens.

Description of Configuration of Embodiment 3

The first connection surface 81 will be described. The first connection surface 81 is formed by a surface that is inclined at an angle that emits the light L1 from the semiconductor-type light source 3, that is, the incident light L5 entering from the first connection surface 81 to the auxiliary lens part 7 exits downward to the outside from the light exit surface 72. In other words, the first connection surface 81 is formed by a surface that is inclined at an angle different from the inclination angle of the light entry surface 70 (about 20° in this example). The angle is an angle of punching a mold for forming the lens 2. As described above, the first connection surface 81 has been designed so that the incident light L5 entering from the first connection surface 81 to the auxiliary lens part 7 does not reflect on the reflection surface 71.

Here, as shown in FIG. 12, the light L1 from the semiconductor-type light source 3, that is, the incident light L5 entering from the first connection surface 81 to the auxiliary lens part 7 is not subjected to light distribution. The incident light L5 not subjected to light distribution is emitted downward to the outside from the light exit surface 72 by adjusting the angle of punching the mold of the first connection surface 81. In other words, the exit light L6 emitted from the light exit surface 72 is a downward light.

A light shielding part 9A will be described. The light shielding part 9A is provided in the vicinity of the light exit surface 72 of the auxiliary lens part 7. The light shielding part 9A is provided integrally with the bottom of the concave part 51 of the lens holder 5. The light shielding part 9A shields the downward exit light L61 entering from the first connection surface 81 to the auxiliary lens part 7 and exiting to the outside from the light exit surface 72.

Description of Functions of Embodiment 3

Figure 11:
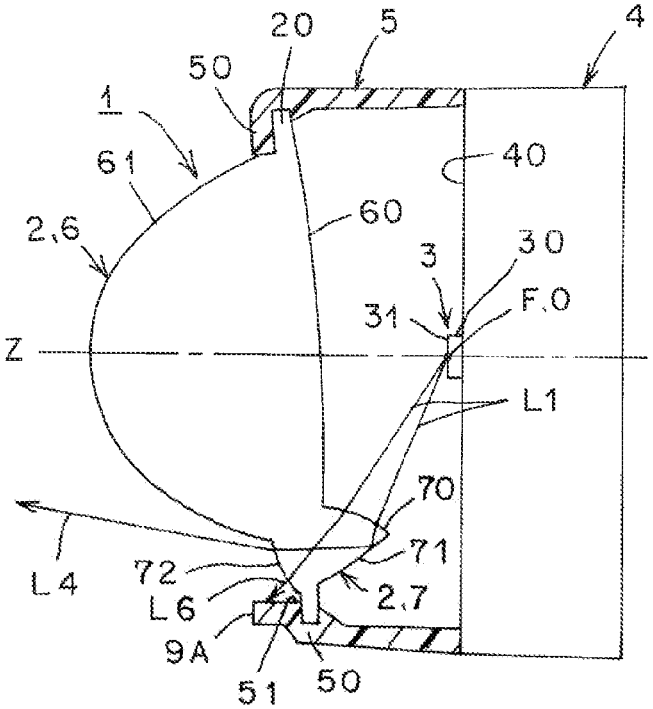
FIG. 11 is a sectional view taken along line II-II in FIG. 10 (embodiment 3).

As shown in FIG. 12, of the light emitted from the light-emitting chip 30, the light L1 around the semiconductor-type light source 3 refracts and enters the auxiliary lens part 7 from the first connection surface 81. At this time, the light L1 from the semiconductor-type light source 3 is not subjected to light distribution. The incident light L5 entered into the auxiliary lens part 7 and not subjected to light distribution control is refracted downward and emitted to the outside from the light exit surface 72 of the auxiliary lens part 7 by adjusting the angle of punching the mold of the first connection surface 81. The downward exit light L6 not subjected to light distribution control emitted from the light exit surface 72 of the auxiliary lens part 7 is, as shown in FIG. 11, shielded by the light shielding part 9A. As a result, it is possible to prevent the exit light L61 not subjected to light distribution control from exiting to the outside from the auxiliary lens part 7.

Description of Effect of Embodiment 3

In the vehicle lamp 1 according to the embodiment 3, by adjusting an angle of punching a mold of the first connection surface 81, it is possible to emit the light L1 from the semiconductor-type light source 3, that is, the incident light L51 entering from the first connection surface 81 to an auxiliary lens part 7, downward to the outside from the light exit surface 72. In other words, the downward exit light L61 is emitted from the light exit surface 72. As a result, glare is not given to a driver of an oncoming vehicle or a preceding vehicle.

Figure 15:
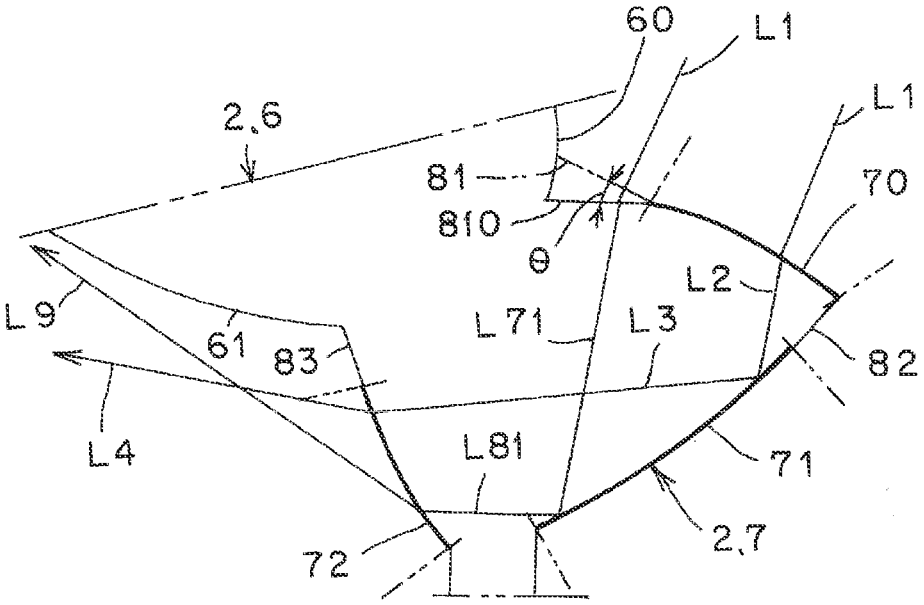
FIG. 15 is a sectional view showing an example of a case where light not being subjected to light distribution is emitted upwardly to the outside from an auxiliary lens part (a sectional view corresponding to FIG. 11 that is a sectional view taken along line II-II in FIG. 10) (embodiment 3).
Figure 16:
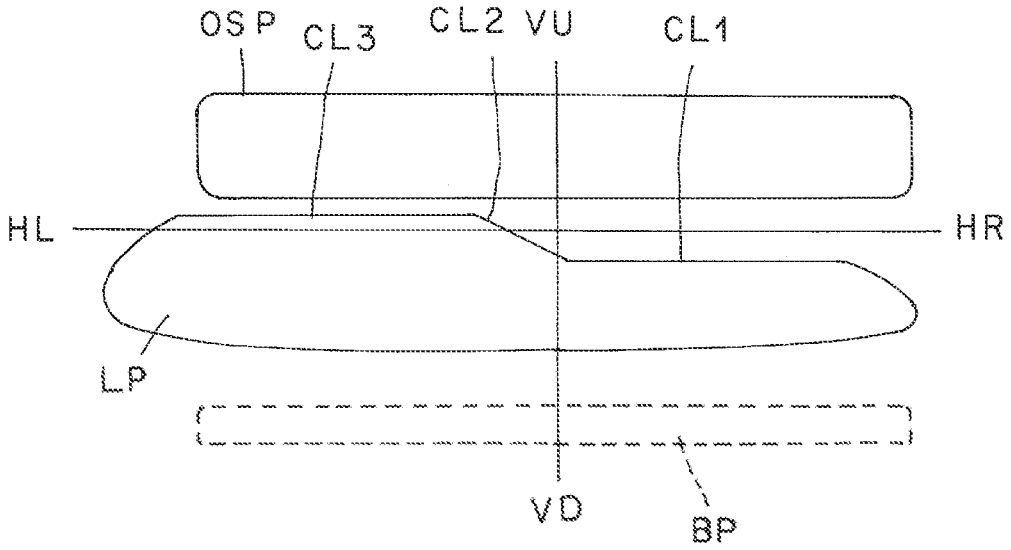
FIG. 16 is an explanatory drawing showing an overhead sign light distribution pattern and a low beam light distribution pattern (embodiment 4).

Here, an angle of punching a mold of the first connection surface 810 shown by a solid line in FIG. 15 is assumed to be an ordinary mold punching angle (e.g., about 2.5°). In other words, the first connection surface 810 is faced substantially parallel to the Z-axis, and substantially perpendicular to the light emission surface 31 of the semiconductor-type light source 3. Then, the light L1 from the semiconductor-type light source 3 refracts and enters the auxiliary lens part 7 from the first connection surface 810. At this time, the light L1 from the semiconductor-type light source 3 is not subjected to light distribution control. The incident light L71 entered into the auxiliary lens part 7 and not subjected to light distribution totally reflects on the reflection surface 71. At this time, the reflection light L81 from the reflection surface 71 is not subjected to light distribution control. The reflection light L81 totally reflected on the reflection surface 71 and not subjected to light distribution control refracts and exits upward from the light exit surface 72. At this time, the upward exit light L91 from the light exit surface 72 is not subjected to light distribution control. As described above, the upward exit light L91 may exit from the light exit surface 72.

On the contrary, according to the vehicle lamp 1 in this embodiment 3, as described above, an angle of punching a mold of the first connection surface 81 is adjusted to an angle θ greater than the angle of punching the mold of the first connection surface 810. In other words, the first connection surface 81 is opposed to intersect the Z-axis and the light emission surface 31 of the semiconductor-type light source 3. Then, the incident light L51 entering from the first connection surface 81 is emitted from the light exit surface 72 as a downward exit light L61. As a result, glare is not given to a driver of an oncoming vehicle or a preceding vehicle.

In the vehicle lamp 1 according to the embodiment 3, the light shielding part 9A shields the light L1 from the semiconductor-type light source 3, that is, the downward exit light L61 entering from the first connection surface 81 of the auxiliary lens part 7 to the auxiliary lens part 7 and exiting to the outside from the light exit surface 72 of the auxiliary lens part 7, namely the downward exit light L61 not subjected to the light distribution control by the auxiliary lens part 7 as per a light distribution design. As a result, it is possible to prevent the downward exit light L61 not subjected to the light distribution control from exiting to the outside from the auxiliary lens part 7, and glare is not given to a driver of an oncoming vehicle or a preceding vehicle.

In the vehicle lamp 1 according to the embodiment 3, the light shielding part 9A is provided integrally with the bottom of the concave part 51 of the lens holder 5. Thus, it is unnecessary to provide a separate member as the light shielding part 9A, and it is possible to reduce the number of parts and the manufacturing cost.

In the vehicle lamp 1 according to the embodiment 3, the lens holder 5 comprises a light opaque member, and comprises a low light reflective member, or the surface thereof is treated to be low light reflective. Therefore, it is possible to shield securely the exit light L6 not subjected to light distribution control by the light shielding part 9A, and it is possible to prevent securely the light from exiting to the outside from the auxiliary lens part 7.

In the vehicle lamp 1 according to the embodiment 3, the bending direction of the light exit surface 72 of the auxiliary lens part 7 forming an aspheric convex surface is in the same direction as the bending direction of the light exit surface 61 of the main lens part 6 forming an aspheric convex surface of the main lens part 6. Therefore, the auxiliary lens part 7 is inconspicuous to the main lens part 6, and the appearance is improved. In particular, in the vehicle lamp 1 of this embodiment, as the first connection surface 81 is formed by a surface that is inclined at an angle different from the inclination angle of the light entry surface 70, the bending direction of the light exit surface 72 of the auxiliary lens part 7 is in the same direction as the bending direction of the light exit surface 61 of the main lens part 6, and the appearance is improved. In other words, as in Patent Document 1, when the inclination angle of the connection surface of the additional lens coincides with the inclination angle of the light entry surface, the bending angle of the light entry surface of the convex lens may differ from the bending direction of the light exit surface of the additional lens, and the appearance may become a problem. On the contrary, in the vehicle lamp 1 of this embodiment, as the inclination angle of the first connection surface 81 is different from the inclination angle of the light entry surface 70, the bending direction of the light exit surface 72 of the auxiliary lens part 7 is in the same direction as the bending direction of the light exit surface 61 of the main lens part 6, and the appearance is improved.

Description of Embodiment 4

FIGS. 16 to 19 show an embodiment 4 of the vehicle lamp according to the invention. Hereinafter, the vehicle lamp in the embodiment 4 will be described. In the drawings, the same reference numerals as those in FIGS. 1 to 15 denote the same parts, and a description thereof will be omitted. FIGS. 10 to 13 are also appropriately used in the embodiment 4.

The vehicle lamp according to the embodiment 4 is, as shown in FIG. 11, provided with a lens 2 and a semiconductor-type light source 3. The lens 2 comprises a main lens part 6 and an auxiliary lens part 7. The auxiliary lens part 7 comprises a light entry surface 70, a reflection surface 71, a light exit surface 72, and a first connection surface 81. In the vicinity of the light exit surface 72 of the auxiliary lens part 7, a light shielding part 9A is provided. As a result, in the embodiment of the invention, it is possible to shield exit light L61 not subjected to light distribution control by the light shielding part 9A.

In a conventional vehicle lamp, light from a light-emitting element may exit to the outside from an additional lens without being subjected to light distribution control by an additional lens. In other words, light being not subjected to light distribution control may exit to the outside from an additional lens.

A problem to be solved by the vehicle lamp according to the embodiment 4 is that light being not subjected to light distribution control may exit to the outside from an additional lens.

Description of Configuration of Embodiment 4

As shown in FIG. 12, the light L1 from the semiconductor-type light source 3, that is, the incident light L5 entering from the first connection surface 81 to the auxiliary lens part 7 is not subjected to light distribution control. The incident light L5 not subjected to light distribution control is emitted to the outside from the light exit surface 72. The exit light L6 emitted to the outside from the light exit surface 72 is not subjected to light distribution control.

The light shielding part 9A will be described. The light shielding part 9A is provided in the vicinity of the light exit surface 72 of the auxiliary lens part 7. The light shielding part 9A is provided integrally with the bottom of the concave part 51 of the lens holder 5. The light shielding part 9A shields the exit light L6 entering from the first connection surface 81 to the auxiliary lens part 7 and exiting to the outside from the light exit surface 72.

Description of Effect of Embodiment 4

According to the vehicle lamp 1 in this embodiment, the light shielding part 9A is able to shield the light L1 from the semiconductor-type light source 3, that is, the incident light L61 entering from the first connection surface 81 of the auxiliary lens part 7 to the auxiliary lens part 7 and exiting to the outside from the light exit surface 72 of the auxiliary lens part 7, namely the exit light L61 not subjected to light distribution control by the auxiliary lens part 7 as per a light distribution design. As a result, it is possible to prevent the exit light L61 not subjected to light distribution control from exiting to the outside from the auxiliary lens part 7.

Figure 17:
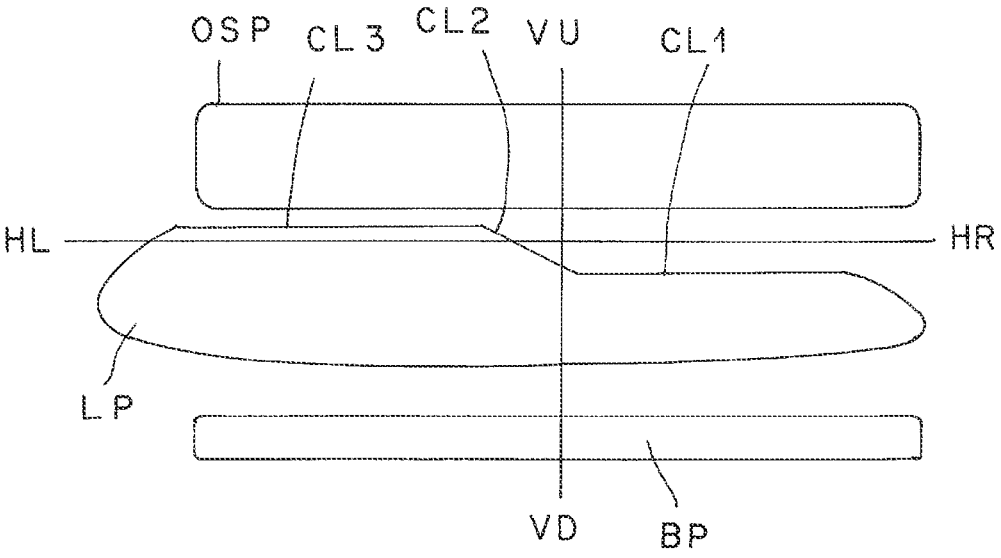
FIG. 17 is an explanatory drawing showing an overhead sign light distribution pattern and a low beam light distribution pattern in a case where light not being subjected to light distribution control has been emitted to the outside from an auxiliary lens part (embodiment 4).
Figure 18:
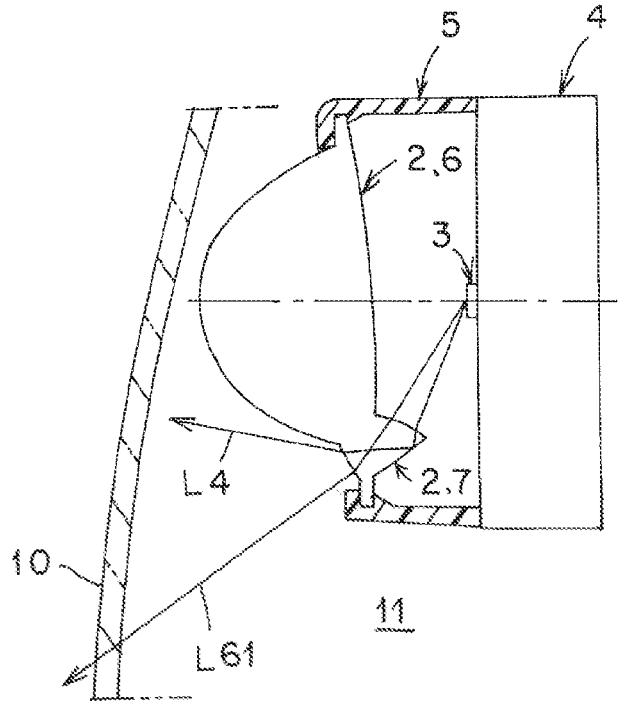
FIG. 18 is a sectional view showing a first example of a case where light not being subjected to light distribution has been emitted to the outside from an auxiliary lens part (a sectional view corresponding to FIG. 11 that is a sectional view taken along line II-II in FIG. 10) (embodiment 4).
Figure 19:
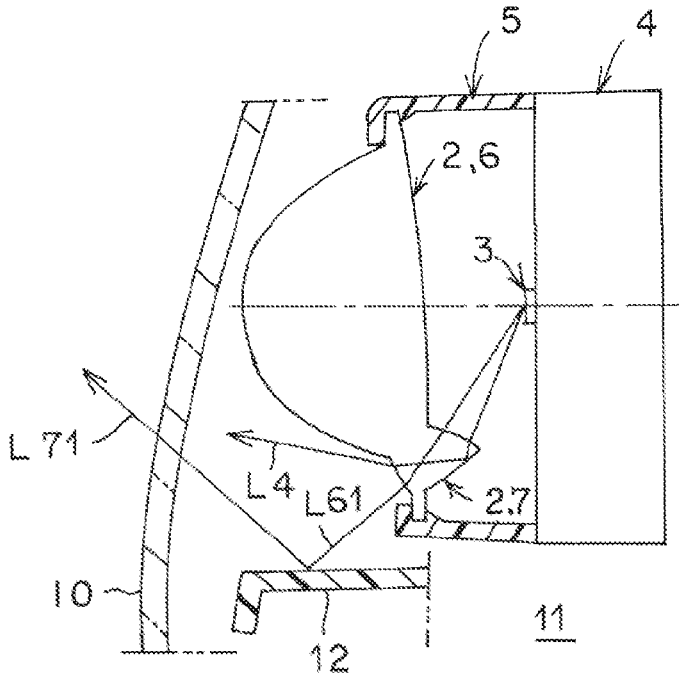
FIG. 19 is a sectional view showing a second example of a case where light not being subjected to light distribution has been emitted to the outside from an auxiliary lens part (a sectional view corresponding to FIG. 11 that is a sectional view taken along line II-II in FIG. 10) (embodiment 4).

Here, as shown in FIGS. 18 and 19, a description will be given on two examples of a case where the light shielding part 9A is not provided. In the example shown in FIG. 18, the exit light L61 emitted from the light exit surface 72 of the auxiliary lens part 7 and not subjected to light distribution control passes obliquely downward through a lamp chamber 11 and a lamp lens 10. Thus, as shown in FIG. 17, a light distribution pattern not subjected to light distribution pattern BP is irradiated below the low beam light distribution pattern LP, namely on a road surface in front of a vehicle. Therefore, below the low beam light distribution pattern LP, a light distribution spot occurs due to the light distribution pattern not subjected to light distribution pattern BP. The light distribution spot may give discomfort to a driver.

The example shown in FIG. 19 depicts an example, in which an inner panel (inner housing) 12 is disposed in the lamp chamber 11, between the lamp lens 10 and the lower side of the lamp unit 2, 3, 4, 5. The surface of the inner panel 12 is treated to have a metallic luster. In this example, the exit light L6 emitted from the light exit surface 72 of the auxiliary lens part 7 and not subjected to light distribution control is irradiated obliquely downward and reflected by the inner panel 12. The reflection light L71 not subjected to light distribution control passes obliquely downward through the lamp chamber 11 and the lamp lens 10. Thus, the reflection light L71 not subjected to light distribution control may become an upward glare.

On the contrary, in the vehicle lamp 1 according to the embodiment 4, as described above, since the exit light L61 not subjected to light distribution control is shielded by the light shielding part 9A, it is possible to prevent the light from exiting to the outside from the auxiliary lens part 7. In other words, as indicated by a broken line in FIG. 16, it is possible to eliminate the light distribution pattern not subjected to light distribution pattern BP. As a result, a driver is not given discomfort due to a light distribution spot. Further, an upward glare does not occur.

In the vehicle lamp 1 according to the embodiment 4, the light shielding part 9A is provided integrally with the bottom of the concave part 51 of the lens holder 5. Thus, it is unnecessary to provide a separate member as a light shielding part 9A, and it is possible to reduce the number of parts and the manufacturing cost.

In the vehicle lamp 1 according to the embodiment 4, the lens holder 5 comprises a light opaque member, and comprises a low light reflective member, or the surface thereof is treated to be low light reflective. Therefore, it is possible to shield securely the exit light L6 not subjected to light distribution control by the light shielding part 9A, and it is possible to prevent securely the light from exiting to the outside from the auxiliary lens part 7.

In the vehicle lamp 1 according to the embodiment 4, the bending direction of the light exit surface 72 of the auxiliary lens part 7 forming an aspheric convex surface is in the same direction as the bending direction of the light exit surface 61 of the main lens part 6 forming an aspheric convex surface. Therefore, the auxiliary lens part 7 is inconspicuous to the main lens part 6, and the appearance is improved.

Description of Embodiment 5

FIGS. 20 to 25 show an embodiment 5 of the vehicle lamp according to the invention. Hereinafter, the vehicle lamp in the embodiment 5 will be described. In the drawings, the same reference numerals as those in FIGS. 1 to 19 denote the same parts, and a description thereof will be omitted.

Figure 21:
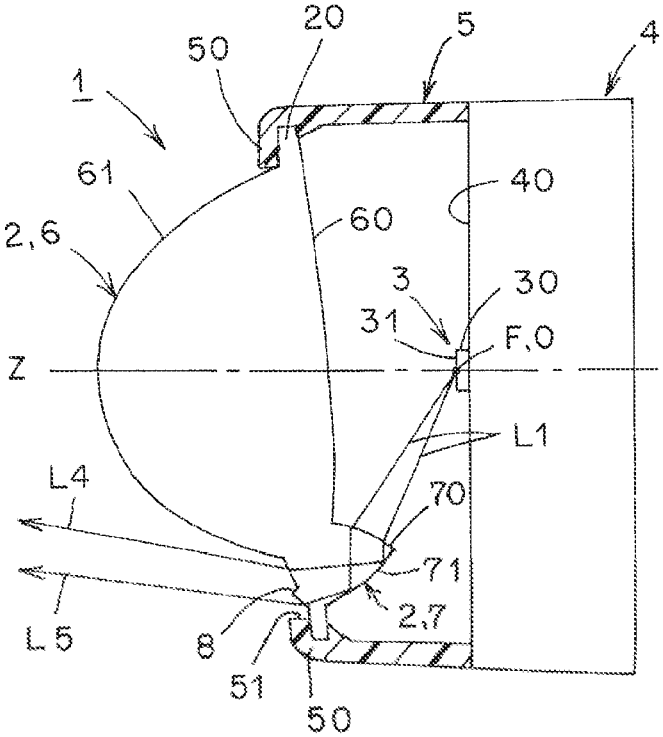
FIG. 21 is a sectional view taken along line II-II in FIG. 20 (embodiment 5).

The vehicle lamp according to the embodiment 5 is, as shown in FIG. 21, provided with a lens 2 and a semiconductor-type light source 3. The lens 2 comprises a main lens part 6 and an auxiliary lens part 7. The auxiliary lens part 7 comprises a light entry surface 70, a reflection surface 71, and a light exit surface 72. On the vicinity of the light exit surface 72 of the auxiliary lens part 7 or in the vicinity of the light exit surface 72, a prism 8 or a light shielding part 80 is provided as a light distribution control part. As a result, in the embodiment of the invention, it is to precisely control light distribution of an overhead sign light distribution pattern OSP.

In a conventional vehicle lamp, it is important to precisely control light distribution of an additional light distribution pattern.

A problem to be solved by the vehicle lamp according to the embodiment 5 is that it is important to precisely control light distribution of an auxiliary light distribution pattern.

Description of Configuration of Embodiment 5

Figure 24:
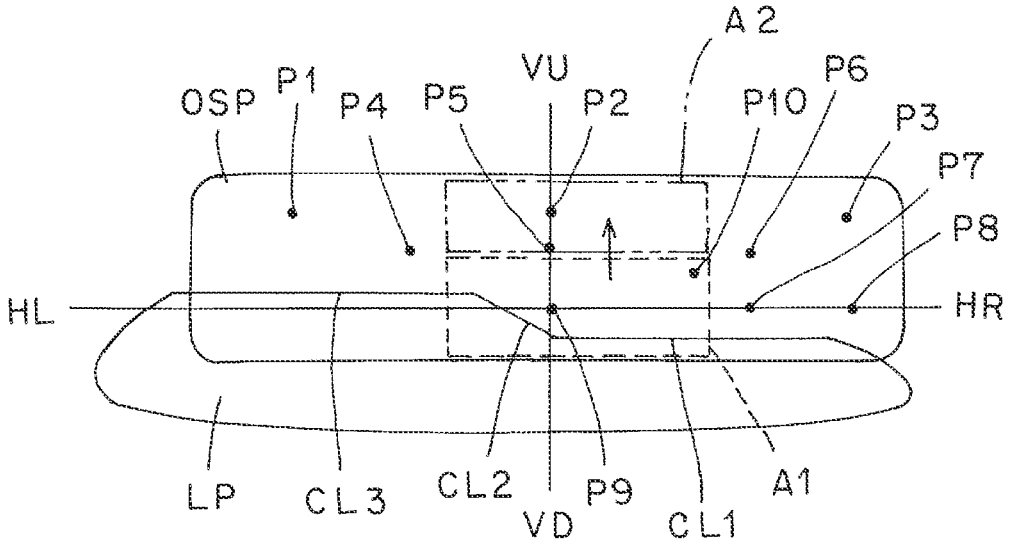
FIG. 24 is an explanatory drawing showing an overhead sign light distribution pattern and a low beam light distribution pattern, which have been partially subjected to light distribution control (embodiment 5).

In the overhead sign light distribution pattern OSP, a brightness (luminosity) range is restricted from a lower limit to an upper limit. For example, as shown in FIG. 24, at a first point P1, a second point P2, and a third point P3 on a horizontal line of 4° above the horizontal line HL-HR extending from the left to the right of a screen, a brightness range from a lower limit to an upper limit is restricted to 65 to 625 [cd]. A brightness range from a lower limit to an upper limit is restricted to 125 to 625 [cd] at a fourth point P4, a fifth point P5, and a sixth point P6 on a horizontal line of 2° above the horizontal line HL-HR extending from the left to the right of a screen. A brightness range from a lower limit to an upper limit is restricted to 125 to 625 [cd] at a seventh point P7 on the horizontal line HL-HR extending from the left to the right of a screen, and 65 to 625 [cd] at an eighth point P8.

In the overhead sign light distribution pattern OSP, an upper limit of brightness (luminosity) is restricted to prevent flare. For example, as shown in FIG. 24, the upper limit of brightness is restricted to 625 [cd] at a ninth point P9 of a glare restriction point at the intersection of the vertical line VU-VD extending from the top to the bottom of the screen and the horizontal line HL-HR extending from the left to the right of a screen. The upper limit of brightness is restricted to 350 [cd] at a tenth point P10 of a glare restriction point corresponding to the eyes (line of sight) of a driver of an incoming vehicle.

(Description of Prism 8)

Figure 20:
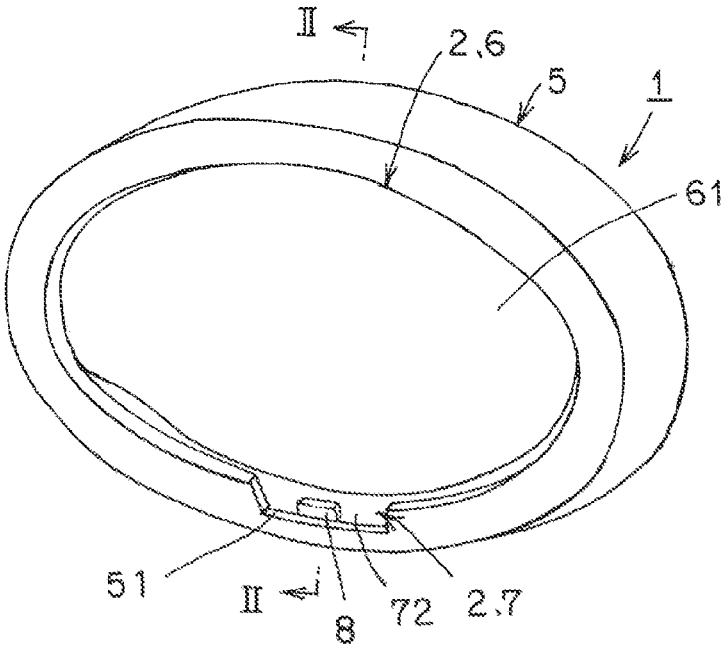
FIG. 20 is a perspective view showing an embodiment 5 of a vehicle lamp according to an embodiment of the present invention.
Figure 22:
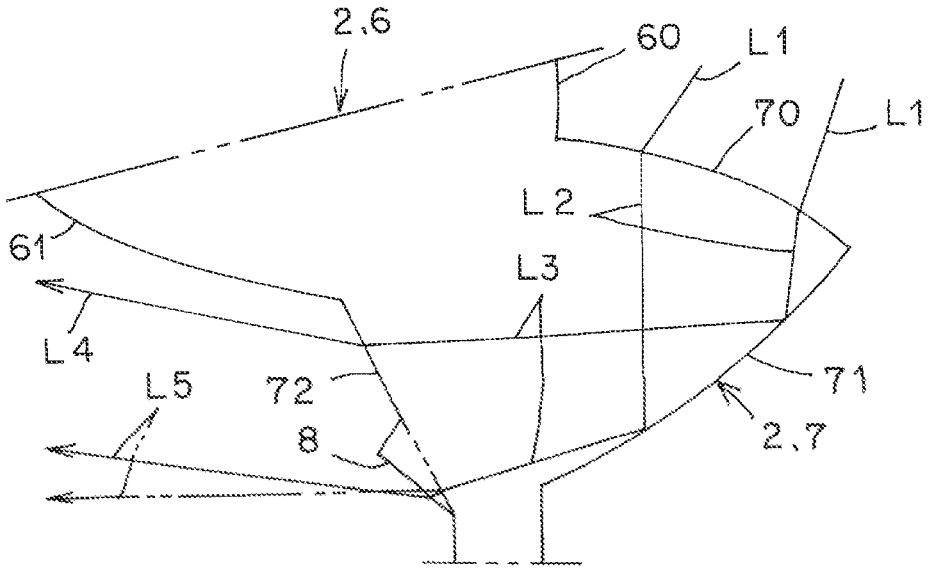
FIG. 22 is an explanatory drawing showing an optical path in an auxiliary lens part (embodiment 5).
Figure 23:
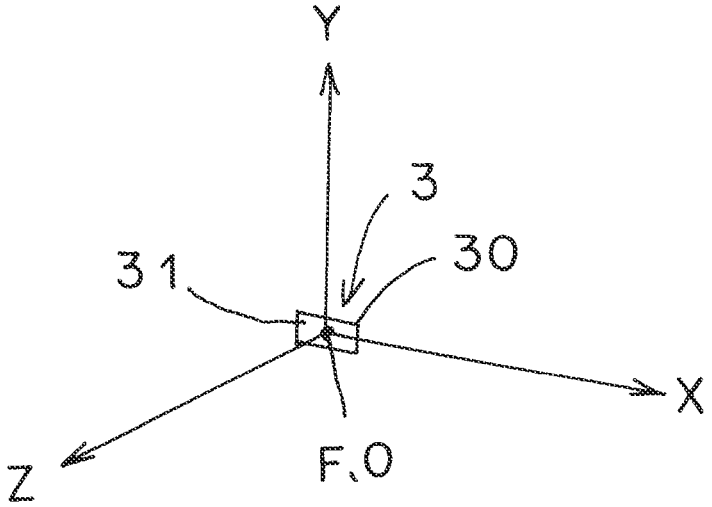
FIG. 23 is an explanatory drawing showing a light emission surface of a light-emitting chip of a semiconductor-type light source (embodiment 5).

As shown in FIGS. 20 to 22, on the light exit surface 72 of the auxiliary lens part 7, a prism (step prism) 8 is provided as a light distribution control part. The prism 8 is provided in the center of the bottom of the light exit surface 72.

The prism 8 is formed by changing an angle of a part of the light exit surface 72 of the auxiliary lens part 7 (a part indicated by the two-dot chain line in FIG. 22). As a result, the prism 8 changes a part L5 of the exit light L4 from the exit direction indicated by the two-dot chain line in FIG. 22 to the exit direction indicated by the solid line in FIG. 22. In other words, as shown in FIG. 24, the prism 8 controls the light distribution of a part A1 of the overhead sign light distribution pattern OSP to shift to an upper part A2 of the overhead sign light distribution pattern OSP.

The part A1 is a range in the vicinity of the oblique cutoff line CL2 (a range surrounded by the broken line in FIG. 24). In other words, the part A1 is a range including the ninth point P9 and the tenth point P10. The part A1 is a range of the lower half of the central part of the overhead sign light distribution pattern OSP. The upper part A2 is a range above the part A1 (a range surrounded by the two-dot chain line in FIG. 24). The upper part A2 is a range including the second point P2 and the fifth point P5. The upper part A2 is a range of the upper half of the central part of the overhead sign light distribution pattern OSP.

Here, as indicated by the solid line arrows in FIG. 22, the part L5 of the exit light L4 is refracted upward by the prism 8 and emitted. In other words, the part L5 of the exit light L4 is emitted in the upward direction with respect to the exit direction of the part L5 of the exit light L4 (refer to the two-dot chain line arrows in FIG. 22) in the case where the prism 8 is not provided.

As a result, the part A1 of the overhead sign light distribution pattern OSP is shifted to the upper part A2 of the overhead sign light distribution pattern OSP. Thus, the brightness (luminosity) decreases in the range in the vicinity of the oblique cutoff line CL2 (a range surrounded by the broken line in FIG. 24), that is, the range including the ninth point P9 and the tenth point P10 of glare restriction. On the other hand, the brightness (luminosity) increases in the range above the part A1 (a range surrounded by the two-dot chain line in FIG. 24), that is, the range including the second point P2 and the fifth point P5 on the vertical line VU-VD extending from the top to the bottom of the screen.

Description of Effect of Embodiment 5

The vehicle lamp 1 in the embodiment 5 has the configuration and functions described above. Hereinafter, the effect of the embodiment will be described.

In vehicle lamp 1 according to the embodiment 5, the prism 8 as a light distribution control part is configured to control light distribution of the overhead sign light distribution pattern OSP to shift the part A1 to the upper part A2. As a result, it is possible to control precisely the light distribution of the overhead sign light distribution pattern OSP.

In other words, it is possible to decrease the brightness of the range A1 of the overhead sign light distribution pattern OSP in the vicinity of the oblique cutoff line CL2 where the brightness tends to too bright. As a result, it is possible to control the brightness of the ninth point P9 and the tenth point P10 of glare restriction within the upper limit of the glare restriction.

On the other hand, it is possible to increase the brightness of the range A2 above the part A1 of the overhead sign light distribution pattern OSP where the brightness tends to too dark. As a result, it is possible to control the brightness of a second point P2 and a fifth point P5 of brightness restriction within the range from the lower limit to the upper limit of the brightness restriction.

Herein, as indicated by the two-dot chain line in FIG. 22, a description will be given on the case where the prism 8 is not provided on the light exit surface 72 of the auxiliary lens part 7. In this case, as indicated by the two-dot chain line arrows in FIG. 22, the part L5 of the exit light L4 is emitted in a substantially horizontal direction. In other words, the part L5 of the exit light L4 is emitted in the downward exit direction with respect to the exit direction of the part L5 of the exit light L4 (refer to the solid line arrows in FIG. 22) in the case where the prism 8 is provided.

Figure 25:
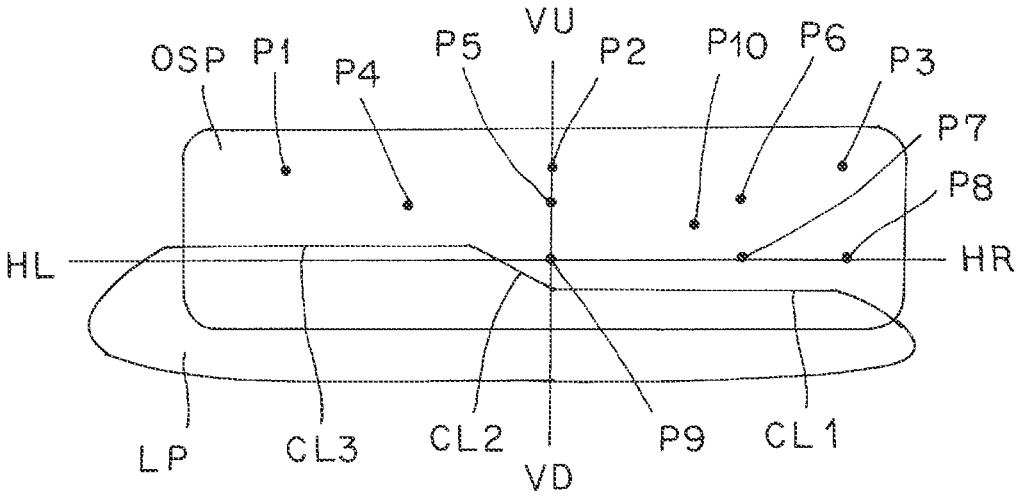
FIG. 25 is an explanatory drawing showing an ordinary overhead sign light distribution pattern and a low beam light distribution pattern (embodiment 5).
Figure 26:
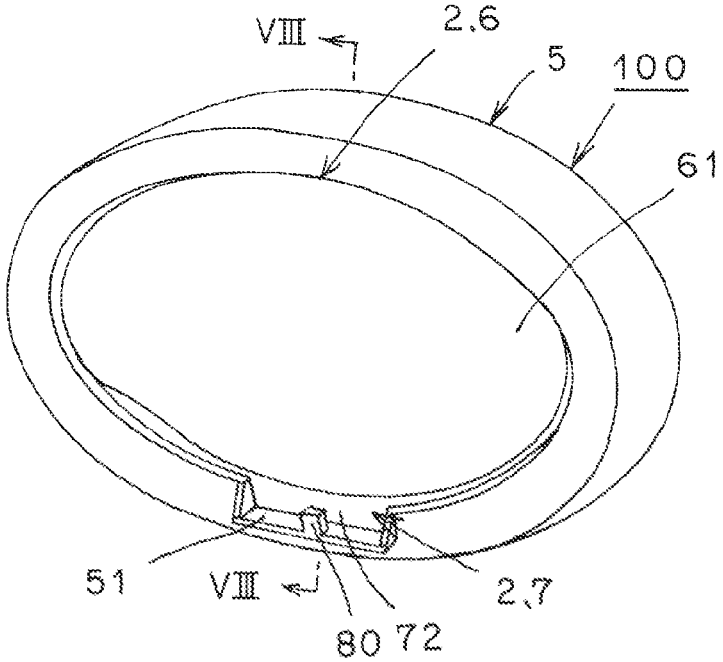
FIG. 26 is a perspective view showing an embodiment 6 of a vehicle lamp according to an embodiment of the present invention.

Thus, is it possible to obtain the overhead sign light distribution pattern OSP shown in FIG. 25. The brightness of the range of the lower half of the central part of the overhead sign light distribution pattern OSP (the range A1 in FIG. 24) tends to too bright. As a result, it is difficult to control the brightness of the ninth point P9 and the tenth point P10 of glare restriction within the upper limit of the glare restriction.

On the other hand, the brightness of the range of the upper half of the central part of the overhead sign light distribution pattern OSP (the range A2 in FIG. 24) tends to too dark. As a result, it is difficult to control the brightness of the second point P2 and the fifth point P5 of brightness restriction within the range from the lower limit to the upper limit of the brightness restriction.

On the contrary, in the vehicle lamp 1 according to the embodiment 5, as described above, it is possible to control the brightness of the ninth point P9 and the tenth point P10 of glare restriction within the upper limit of the glare restriction. On the other hand, it is possible to control the brightness of the second point P2 and the fifth point P5 of brightness restriction within the range from the lower limit to the upper limit of the brightness restriction.

In the vehicle lamp 1 according to the embodiment 5, the prism 8 as a light distribution control part is formed by changing the angle of a part (a part indicated by the two-dot chain line in FIG. 22) of the exit surface 72 of the auxiliary lens part 7. Thus, it is unnecessary to provide a separate member as a light distribution control part, and it is possible to reduce the number of parts and the manufacturing cost.

Further, the prism 8 shifts the part A1 of the overhead sign light distribution pattern OSP to the upper part A2. Thus, it is possible to use effectively most of the light from the semiconductor-type light source 3.

In the vehicle lamp 1 according to the embodiment 5, the part A1 of the overhead sign light distribution pattern OSP subjected to light distribution control by the prism 8 is the range in the vicinity of the oblique cutoff line CL2 of the low beam light distribution pattern LP. As a result, the embodiment is suitable for an overhead sign light distribution pattern OSP whose lower boundary line is located below the oblique cutoff line CL2.

Description of Embodiment 6

FIGS. 26 to 29 show an embodiment 6 of the vehicle lamp according to the invention. Hereinafter, the vehicle lamp in the embodiment 6 will be described. In the drawings, the same reference numerals as those in FIGS. 1 to 25 denote the same parts, and a description thereof will be omitted.

Description of Configuration of Embodiment 6

In the vehicle lamp 1 according to the embodiment 5, a light distribution control part is the prism 8. On the contrary, in a vehicle lamp 100 according to the embodiment 6, a light distribution control part is a light shielding part 80. The light shielding part 80 is provided integrally with a central part of the bottom of a concave part 51 of a lens holder 5. In other words, the light shielding part 80 is provided in the vicinity of a light exit surface 72 of an auxiliary lens part 7. The light shielding part 80 is faced to the center of the lower part of the light exit surface 72. The center of the lower part of the light exit surface 72 corresponds to the center of the lower part of the light exit surface 72 on which the prism 8 is provided.

Figure 28:
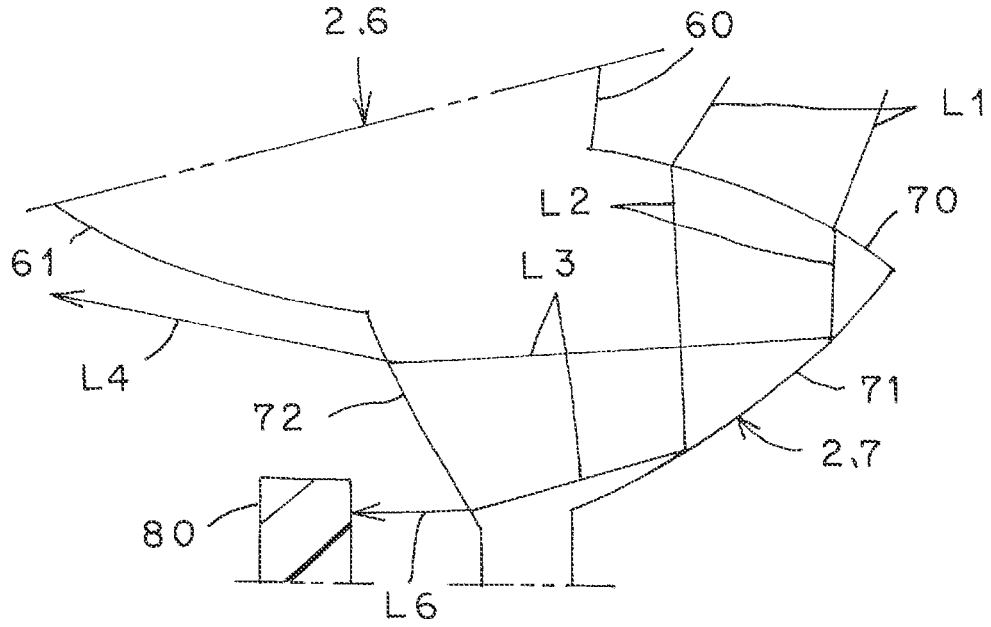
FIG. 28 is an explanatory drawing showing an optical path in an auxiliary lens part (embodiment 6).
Figure 29:
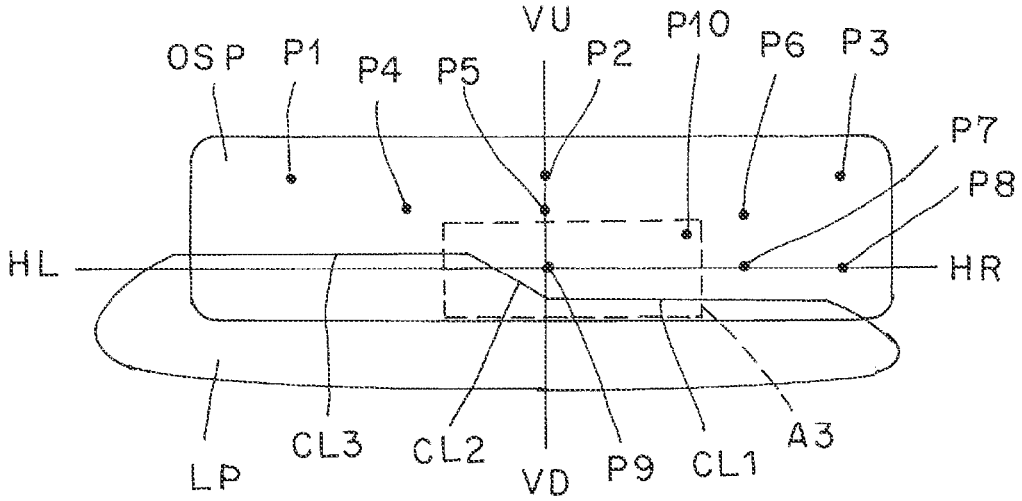
FIG. 29 is an explanatory drawing showing an overhead sign light distribution pattern and a low beam light distribution pattern, which has been partially subjected to light distribution control (embodiment 6).

The light shielding part 80 shields a part L6 of the exit light L4 as shown in FIG. 28. In other words, as shown in FIG. 29, the light shielding part 80 controls the light distribution of the overhead sign light distribution pattern OSP to shield a part A3 (a range surrounded by the broken line in FIG. 29). The part A3 is, like the part A1 of the vehicle lamp 1 in the embodiment 5, a range in the vicinity of the oblique cutoff line CL2 of the low beam light distribution pattern LP. In other words, the part A3 is a range including a ninth point P9 and a tenth point P10 of glare restriction. The part A3 is a range of the lower half of the central part of the overhead sign light distribution pattern OSP.

Description of Functions of Embodiment 6

A vehicle lamp 100 in this embodiment 6 is configured as described above. Hereinafter, the functions of the embodiment will be described.

When the light-emitting chip 30 of the semiconductor-type light source 3 is turned on, of the light emitted from the light-emitting chip 30, the light in the center of the semiconductor-type light source 3 is irradiated to the forward of a vehicle via the main lens part 6 as a low beam light distribution pattern LP having cutoff lines CL1, CL2, CL3 as shown in FIG. 29.

Figure 27:
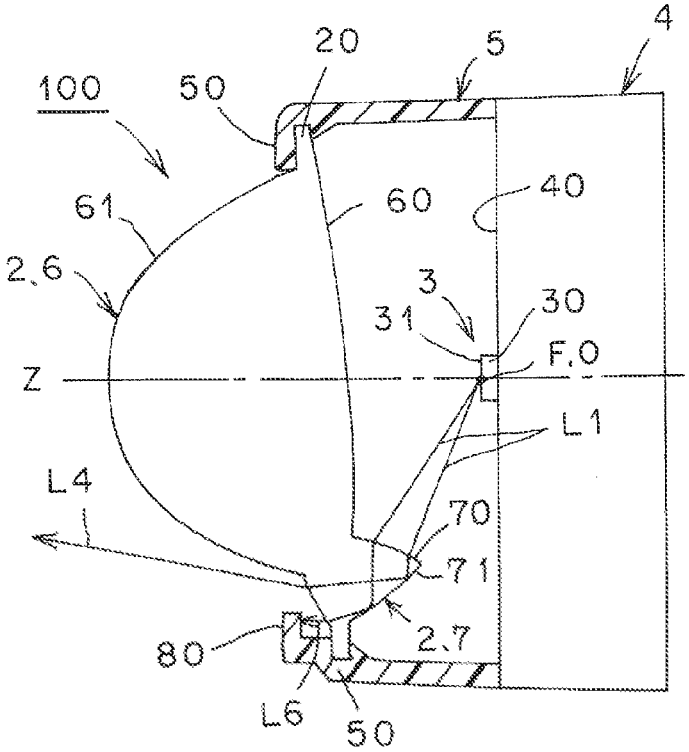
FIG. 27 is a sectional view taken along line VIII-VIII in FIG. 26 (embodiment 6).

On the other hand, as shown in FIGS. 27 and 28, of the light emitted from the light-emitting chip 30, the light L1 around the semiconductor-type light source 3 is, as shown in FIG. 29, irradiated to the forward and upward of a vehicle as an overhead sign light distribution pattern OSP via the auxiliary lens part 7.

Here, the part L6 of the exit light L4 is shielded by the light shielding part 80 as indicated by the solid line arrows in FIGS. 27 and 28. As a result, a part A3 of the overhead sign light distribution pattern OSP is shielded. This decreases the brightness (luminosity) of the range in the vicinity of the oblique cutoff line CL2 (the range surrounded by the broken line in FIG. 29), that is, the range including the ninth point P9 and the tenth point P10 of the glare restriction.

Description of Effect of Embodiment 6

The vehicle lamp 100 in the embodiment 6 has the configuration and functions as described above. Hereinafter, the effect of the embodiment will be described.

In the vehicle lamp 100 according to the embodiment 6, it is possible to achieve the similar effect as that of the vehicle lamp 1 in the embodiment 5. In particular, in the vehicle lamp 100 according to the embodiment 6, the light shielding part 80 as a light distribution control part is provided integrally with a part of the bottom of the concave part 51 of the lens holder 5. Thus, it is unnecessary to provide of a separate member as a light distribution control part, and it is possible to reduce the number of parts and the manufacturing cost. Further, the light shielding part 80 shields a part A3 of the overhead sign light distribution pattern OSP. Thus, it is possible to control the brightness of the ninth point P9 and the tenth point P10 of glare restriction of the part A3 of the overhead sign light distribution control pattern OSP within the upper limit of the glare restriction.

(Description of Examples Other than the Above Embodiments)

In each embodiment of the invention, a description has been given on the vehicle lamp 1 for left-hand traffic. However, an embodiment of the invention is also applicable to a vehicle lamp for right-hand traffic.

Further, in each embodiment, the main lens part 6 and the auxiliary lens part 7 of the lens 2 are integral. However, in an embodiment of the invention, a main lens part and an auxiliary lens part of a lens may be separate.

Further, in each embodiment, the auxiliary lens part 7 is provided on the lower side of the main lens part 6. However, in an embodiment of the invention, an auxiliary lens part may be provided on the upper side, the left side, or the right side of a main lens part.

Furthermore, in each embodiment, the auxiliary lens part 7 radiates the overhead sign light distribution pattern OSP. However, in and embodiment of the invention, an auxiliary lens part may radiate a light distribution pattern other than an overhead sign light distribution pattern, for example, a fog light distribution pattern and a cornering light distribution pattern.

Still further, in each embodiment, the first connection surface 81 is provided with the light processing part 9, 90 of a prism structure. However, in an embodiment of the invention, instead of the light processing part 9, 90 of a prism structure, a mask may be provided on the first connection surface to shield light entering from the first connection surface to the auxiliary lens part. Or, instead of the light processing part 9, 90 of a prism structure, an emboss or a fisheye prism may be provided on the first connection surface to diffuse an incident light entering from the first connection surface to the auxiliary lens part.

Further, in each embodiment, a description has been given on the example that the upward exit light L7 is emitted from the light exit surface 72. However, an embodiment of the invention is also applicable to the case where a downward exit light is emitted from a light exit surface. In this case, it is possible to diffuse or shield a light distribution pattern emitted below a low beam light distribution pattern, namely on a road surface in front of a vehicle. Thus, it is possible to prevent occurrence of a distribution spot due to a light distribution pattern BP below a low beam light distribution pattern, and it is possible to prevent discomfort to a driver.

Furthermore, in the embodiment 3, the light shielding part 9A is provided. However, in an embodiment of the invention, a light shielding part may not be provided.

DESCRIPTION OF REFERENCE NUMERALS

1 Vehicle lamp
10 Lamp lens
11 Lamp chamber
12 Inner panel
2 Lens
20 Flange part
3 Semiconductor-type light source
30 Light-emitting chip
31 Light emission surface
4 Heat sink member
40 Mounting surface
5 Lens holder
50 Fitting part
51 Concave part
6 Main lens part
60 Light entry surface of main lens part
61 Light exit surface of main lens part

7 Auxiliary lens part
70 Light entry surface of auxiliary lens part
71 Reflection surface of auxiliary lens part
72 Light exit surface of auxiliary lens part
8 Prism
80 Light shielding part
A1, A3 Part
A2 Upper part
P1, P2, P3, P4, P44, P5, P6, P7, P8, P9, P10 Point
81 First connection surface
82 Second connection surface
83 Third connection surface
810 First connection surface
9, 90 Light processing part
9A Light shielding part
BP Light distribution pattern not subjected to light distribution control
CL1 Lower horizontal cutoff line
CL2 Oblique cutoff line
CL3 Upper horizontal cutoff line
F Reference focus of lens
GP Light distribution pattern
HL-HR Horizontal line extending from the left to the right of a screen
HWP Diffused light distribution pattern diffused in a lateral direction
L1 Light
L2 Incident light
L3 Reflection light
L4 Exit light
L5 Incident light diffused in a lateral direction
L6 Reflection light diffused in a lateral direction
L7 Exit light diffused in a lateral direction
L51 Incident light not subjected to light distribution control
L61 Downward exit light
L71 Incident light not subjected to light distribution control
L81 Reflection light not subjected to light distribution control
L91 Upward exit light
LP Low beam light distribution pattern
O Center of light emission surface of light-emitting chip
OSP Overhead sign light distribution pattern
VU-VD Vertical line extending from the top to the bottom of a screen
VWP Diffused light distribution pattern diffused in a lateral direction
X X-axis
Y Y-axis
Z Reference optical axis of lens (Z-axis)
θ Large angle

The invention claimed is:

1. A vehicle lamp comprising a lens and a semiconductor-type light source, wherein:

the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part;

a reflection surface that reflects light entering from the light entry surface to the auxiliary lens part;

a light exit surface that emits a reflection light reflected by the reflection surface to the outside from the auxiliary lens part; and a connection surface that connects the main lens part and the light entry surface; and the connection surface is provided with a light processing part that diffuses or shields light from the semiconductor-type light source.

2. The vehicle lamp according to claim 1, wherein the light processing part comprises a diffusion prism that diffuses light from the semiconductor-type light source.

3. The vehicle lamp according to claim 1, wherein:

the main lens part comprises a light entry surface that is connected to the light entry surface of the auxiliary lens part via the connection surface; and a light exit surface that forms an aspheric convex surface, the light exit surface of the auxiliary lens part forms an aspheric convex surface, and a bending direction of the light exit surface of the auxiliary lens part forming an aspheric convex surface is in the same direction of a bending direction of the light exit surface of the main lens part forming an aspheric surface.

4. A vehicle lamp comprising a lens and a semiconductor-type light source, wherein:

the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part;

a reflection surface that reflects light entering from the light entry surface to the auxiliary lens part;

a light exit surface that emits a reflection light reflected by the reflection surface to the outside from the auxiliary lens part; and a connection surface that connects the main lens part and the light entry surface; and the connection surface is formed by a surface inclined at an angle for emitting light from the semiconductor-type light source, that is, light entering from the connection surface to the auxiliary lens part, downwardly to the outside from the light exit surface of the auxiliary lens part.

5. The vehicle lamp according to claim 4, wherein:

a flange part is provided on a periphery of the main lens part and the auxiliary lens part, the flange part is attached to a lens holder, and the lens holder is provided with a light shielding part that shields light emitted downwardly to the outside from a light exit surface of the auxiliary lens part.

6. The vehicle lamp according to claim 4, wherein the lens holder comprises a light opaque member, and comprises a low light reflective member, or a surface thereof is treated to be low light reflective.

7. The vehicle lamp according to claim 4, wherein:

the main lens part comprises a light entry surface that is connected to the light entry surface of the auxiliary lens part via the connection surface, and a light exit surface that forms an aspheric convex surface, the light exit surface of the auxiliary lens part forms an aspheric convex surface, and a bending direction of the light exit surface of the auxiliary lens part forming an aspheric convex surface is in the same direction as a bending direction of the light exit surface of the main lens part forming an aspheric convex surface.

8. A vehicle lamp comprising a lens and a semiconductor-type light source, wherein:

the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part;

a reflection surface that reflects light entering from the light entry surface to the auxiliary lens part;

a light exit surface that emits a reflection light reflected by the reflection surface to the outside from the auxiliary lens part; and a connection surface that connects the main lens part and the light entry surface; and a light shielding part is provided in the vicinity of a light exit surface of the auxiliary lens part, the light shielding part shielding light from the semiconductor-type light source, that is, light entering from the connection surface to the auxiliary lens part, and exiting to the outside from the light exit surface of the auxiliary lens part.

9. The vehicle lamp according to claim 8, wherein:

a flange part is provided on a periphery of the main lens part and the auxiliary lens part, the flange part is attached to a lens holder, and the light shielding part is provided in the lens holder.

10. The vehicle lamp according to claim 9, wherein the lens holder comprises a light opaque member, and comprises a low light reflective member, or a surface thereof is treated to be low light reflective.

11. The vehicle lamp according to claim 10, wherein:

the main lens part comprises a light entry surface that is connected to the light entry surface of the auxiliary lens part via the connection surface, and a light exit surface that forms an aspheric convex surface, the light exit surface of the auxiliary lens part forms an aspheric convex surface, and a bending direction of the light exit surface of the auxiliary lens part forming an aspheric convex surface is in the same direction as a bending direction of the light exit surface of the main lens part forming an aspheric convex surface.

12. A vehicle lamp comprising a lens and a semiconductor-type light source, wherein:

the lens comprises a main lens part that irradiates light from the semiconductor-type light source as a main light distribution pattern; and an auxiliary lens part, that is provided on a periphery of the main lens part, and irradiates light from the semiconductor-type light source as an auxiliary light distribution pattern, the auxiliary lens part comprises a light entry surface that enters light from the semiconductor-type light source into the auxiliary lens part;

a reflection surface that reflects light entering from the light entry surface to the auxiliary lens part; and a light exit surface that emits a reflection light reflected by the reflection surface to the outside from the auxiliary lens part; and a light distribution control part, that controls a part of light distribution of the auxiliary light distribution pattern, is provided on a light exit surface side of the auxiliary lens part.

13. The vehicle lamp according to claim 12, wherein the light distribution control part is formed by changing an angle of a part of a light exit surface of the auxiliary lens part, and shifts a part of the auxiliary light distribution pattern.

14. The vehicle lamp according to claim 12, wherein the light distribution control part is a light shielding part provided in front of a light exit surface of the auxiliary lens part, and shields a part of the auxiliary light distribution pattern.

15. The vehicle lamp according to claim 12, wherein:

the main light distribution pattern is a low beam light distribution pattern including an oblique cutoff line, the auxiliary light distribution pattern is an overhead sign light distribution pattern, a lower boundary line of the overhead sign light distribution pattern is located below the oblique cutoff line, and a part of the overhead sign light distribution pattern subjected to light distribution control by the light distribution control part is within the vicinity of the oblique cutoff line.

* * * * *